US011846162B2

(12) United States Patent
Jonsjord et al.

(10) Patent No.: US 11,846,162 B2
(45) Date of Patent: Dec. 19, 2023

(54) SUBSEA DEPLOYABLE INSTALLATION AND WORKOVER CONTROL SYSTEM SKID AND METHOD OF INSTALLATION THEREOF

(71) Applicant: FMC Kongsberg Subsea AS, Kongsberg (NO)

(72) Inventors: Ole Vidar Jonsjord, Kongsberg (NO); Kjetil Halset, Kongsberg (NO); Steinar Saugerud, Kongsberg (NO)

( * ) Notice: Subject to any disclaimer, the term of this patent is extended or adjusted under 35 U.S.C. 154(b) by 0 days.

(21) Appl. No.: 17/641,796

(22) PCT Filed: Sep. 9, 2020

(86) PCT No.: PCT/EP2020/075161

§ 371 (c)(1),
(2) Date: Mar. 9, 2022

(87) PCT Pub. No.: WO2021/048181

PCT Pub. Date: Mar. 18, 2021

(65) Prior Publication Data

US 2022/0389794 A1 Dec. 8, 2022

(30) Foreign Application Priority Data

Sep. 9, 2019 (NO) ..... 20191082

(51) Int. Cl.
*E21B 41/00* (2006.01)
*E21B 33/035* (2006.01)
(Continued)

(52) U.S. Cl.
CPC ..... *E21B 41/0007* (2013.01); *E21B 33/0355* (2013.01); *E21B 41/04* (2013.01); *G08C 17/02* (2013.01)

(58) Field of Classification Search
CPC .. E21B 41/0007; E21B 41/04; E21B 33/0355; G08C 17/02
See application file for complete search history.

(56) References Cited

U.S. PATENT DOCUMENTS 8,179,279 B2 * 5/2012 Voss ..... E21B 33/0355 340/854.6
8,746,346 B2 6/2014 Voss
(Continued)

FOREIGN PATENT DOCUMENTS

AU 2015220557 B2 8/2015
CA 1 239 090 A 7/1988
(Continued)

*Primary Examiner* — Aaron L Lembo

(57) ABSTRACT

The invention relates to a subsea deployable installation and workover control system (IWOCS) skid (1) for connection to a subsea component (2), the skid (1) comprising: a wireless communication unit (3) for communication with a wireless communication unit (4) at a topside installation (10); a control system (69) for data storage and/or data filtering and transferring the filtered data to the wireless communication unit (3) and receiving data from the wireless communication unit (3); a self-contained fluid system comprising a fluid supply tank (5, 8), the fluid system being configured to be connected to a fluid connection on the subsea component such as to provide fluid to the subsea component (2); an electric power source (7) for supplying electric power to the communication unit (3) and the control system (69). It is further described a method of performing installation or workover operation(s) on a subsea component using an installation workover control system (IWOCS) skid.

15 Claims, 17 Drawing Sheets

(51) Int. Cl.
*E21B 41/04* (2006.01)
*G08C 17/02* (2006.01)

(56) References Cited

U.S. PATENT DOCUMENTS

| | | | | |
|---|---|---|---|---|
| 8,955,595 | B2 * | 2/2015 | Emecheta | E21B 33/0355 60/415 |
| 10,961,677 | B2 * | 3/2021 | Maher | E02B 17/0034 |
| 11,072,993 | B2 * | 7/2021 | Thoresen | E21B 34/04 |
| 2009/0212969 | A1 | 8/2009 | Voss | |
| 2011/0240303 | A1 | 10/2011 | Hallundbaek | |
| 2016/0305232 | A1 * | 10/2016 | Bird | E21B 47/001 |
| 2017/0321517 | A1 | 11/2017 | Thoresen et al. | |

FOREIGN PATENT DOCUMENTS

| | | | |
|---|---|---|---|
| GB | 2566038 | A | 3/2019 |
| WO | WO 2011/062751 | A2 | 5/2011 |

* cited by examiner

SUBSEA DEPLOYABLE INSTALLATION AND WORKOVER CONTROL SYSTEM SKID AND METHOD OF INSTALLATION THEREOF

BACKGROUND OF THE INVENTION

During lifetime of subsea wells, such as offshore subsea wells, it is necessary and required to perform inspection, intervention and maintenance on the subsea equipment in order to verify that the equipment is capable of handling the expected pressures, temperature and stresses in any direction (angular, torsional and longitudinal). A well intervention, simply referred to as well-work, is any operation carried out on an oil or gas well during, or at the end of, its productive life that alters the state of the well or well geometry, provides well diagnostics, or manages the production of the well. Similar solutions and procedures may be required during installation and start-up of subsea wells.

Well intervention is normally divided into heavy well intervention where large fully-equipped drilling rigs are used due to fulfill requirement of a riser between the floating installation, and light well intervention which is performed from smaller vessels without a riser (i.e. so-called "Riser-Less Light Well Intervention" (RLWI)).

The maintenance may for example be annually and may be of low complexity such as only involve greasing and pressure testing of valves. Examples of such subsea equipment may be Xmas Tree (XT), which is an assembly of valves, spools and fittings used to regulate the flow of pipes in an oil well, gas well, water injection well, water disposal well, gas injection well, condensate well and other types of wells.

When performing maintenance on XT's it is common practice to connect the intervention equipment to dedicated valves or bores on the XT in order to assume control of the XT to perform required tests or maintenance.

One example of a prior art solution is disclosed in U.S. Pat. No. 8,746,346 B2. From this document it is known an electrical and hydraulic configuration on a subsea tree that facilitates the use of an ROV control system to operate the tree during well installations, interventions, and workovers. A Subsea control module (SCM) at the tree is in communication with a fixed junction plate that receives a production umbilical during normal operation. The ROV can be deployed to disconnect and park the production umbilical during well installations, interventions, and workovers to prevent accidental operation of the SCM or tree. The junction plate is configured to connect with the ROV and thereby establish communication with the hydraulic lines of the SCM. The ROV may carry an umbilical from a vessel to provide electrical and hydraulic service to the SCM during well operations. In addition, the ROV has facilities to re-pressurize spent control fluid to thereby allow reuse of the control fluid by the SCM.

To facilitate distribution of the hydraulic fluid in the umbilical to the SCM's control valves, the umbilical may be connected to a receptacle on a junction plate located on the subsea tree. The junction plate typically includes a hydraulic distribution line arrangement extending from the receptacle to the SCM's control valves. Where an umbilical also contains an electrical line, the electrical line can be routed from the receptacle to an electrical connection on the SCM.

At times during the life of a well, equipment must be replaced or installed, or a well workover or intervention may be required. During these operations, it is key that the operation of the subsea tree be temporarily turned over to a surface workover vessel and that the production mode of operation be locked out to prevent accidental operation by sources other than the vessel when critical equipment or workover operations are underway.

To assure that the vessel has complete control of the subsea tree, an installation/workover control system (IWOCS) is typically utilized. The IWOCS skid includes its own umbilical that may contain both hydraulic and electrical feeds to control the subsea tree during the installation or workover operations. Typically, then the production umbilical is disconnected from the receptacle on the junction plate and parked on a seabed parking plate. This assures that the production umbilical will not accidentally operate any of the subsea tree components. The solution in U.S. Pat. No. 8,746,346 B2 is a so-called belly-mounted skid due to its properties of being hung from ROV during installation and work-over.

In all embodiments of the prior art in U.S. Pat. No. 8,746,346 B2, there is a connection line in the form of a flying lead via the ROV for providing power from a surface facility to the components on the IWOCS, and in particular the hydraulics.

On large water depths, umbilicals extending from the floating surface installation to the IWOCS skid installed subsea, incurs a significant cost.

It is a need to address at least one of the drawbacks related to the prior art solutions.

One objective of the invention is to provide a solution requiring a limited number of connections between the IWOCS skid and surface facility during operations on the subsea component.

In one embodiment, it is an objective of the invention to perform operations on the subsea component without physical connection between the IWOCS skid and the surface facility.

SUMMARY OF INVENTION

The invention is set forth in the independent claims, while the dependent claims describe other characteristics of the invention.

In all embodiments of the invention, the IWOCS skid is self-supplied or self-contained with the required pressure in the fluid supply system and/or pump capacity based on expected necessary volume of fluids to perform the different scheduled operations. In other words, the invention relates to an umbilical-less XT control.

The well may comprise a barrier assembly, and the pump (if a pump is forming part of the skid) may have a mode of operation generating pressure build up through a fluid connection from the pump into the well interior for pressurization of the fluid of the well interior with pressure necessary to operate the barrier assembly in the well interior during the temporary fluid flow between the pump and the well interior, thereby opening barrier equipment in the well, such as plugs or valves. Alternatively, if a pump is not forming part of the skid and a pressurized fluid supply system comprising a hydraulic fluid or a chemical injection fluid is used instead, the a pressurized fluid supply system may have sufficient pressure to operate the barrier assembly in the well interior.

After completing the desired operation on any equipment in the well, steps for closing the fluid connection between the pump or the pressurized fluid supply system and the well interior may be carried out.

The pump or the pressurized fluid supply system may be operated to regulate the flow and/or pressure in the pumped or pressurized fluid flowing from the pump or supply system into the well interior through the fluid connection. The equipment in the well may comprise down hole equipment arranged in the well.

The step of operating a valve arrangement by a control unit into a valve configuration arranging a barrier system between a reservoir in fluid communication with the well interior and the surroundings may be carried out during manipulating equipment in the well.

The barrier system may be provided by closing at least one valve of a valve arrangement, and in most circumstances closing at least two of the valves of the valve arrangement.

During the operation of the pump or the pressurized fluid supply system for controlling the operation of down hole equipment, the system and the method may be arranged so that the pumped or pressurized fluid flows into the well interior and flows back out from the well interior in a repeating or alternating manner. By this the down hole equipment is operated with a sequence of pressure build ups in the well interior. Preferably the volume of the pumped or pressurized fluid and the fluid returning from the well interior will have the same or similar volume. If the volumes differ from a predetermined range, control system for shutting down the well can be provided.

The pump or pressurized fluid supply system is arranged on the skid, and the barrier system for instance double barriers, may form part of the valve arrangement arranged on the subsea tool or by another valve arrangement such as the valve arrangement of the Xmas tree or a combination of both valve assemblies. The pump or the pressurized fluid supply system and the valve arrangement controls the fluid flow and or pressure through the fluid connection when the skid is arranged at a subsea installment position.

Arranging the pump or the pressurized fluid supply system on the skid provides an efficient solution and enables improved control of the operation as the means for pressurizing element closer to the equipment thereby reducing time for building the necessary pressure at the down hole equipment and reducing the uncertainties in the procedure.

Further possibilities include closing equipment in a well such as down hole barrier elements and retrieving the Xmas tree from installed position by the running tool.

The valve arrangement arranged on the skid may comprise at least a pump barrier valve for controlling the flow of pumped fluid to the well interior and at least a return barrier valve to control the return of fluid from the well interior. As mentioned above the valve arrangement arranged on the Xmas tree may as an alternative serve the same purpose. This being the case since the method and system is operating down hole equipment without deploying tools on wire or cable or similar through the Xmas tree.

To fulfill the requirement for a double barrier system between the reservoir and the surroundings, an additional pump barrier valve may be provided for controlling the flow of pumped fluid to the well interior and an additional return barrier valve may be provided to control the return of fluid from the well interior to the valve arrangement. The additional pump barrier valve may be located on the skid or on the X-mas tree. The additional return barrier valve may be located on the skid or on the X-mas tree. The fluid connection between the pump and the well interior may be provided through a flow passage system in a Xmas tree installed on a subsea wellhead. The controlling of the fluid flow through the flow passage system may be carried out by the valve arrangement of the skid or the Xmas tree, or the combination of both valve arrangements.

The invention provides a solution which saves time in installation and work-over operations. The invention may be used in performing operations on components such as, but not limited to:

- Xmas Tree (XT) and manifold installation,
- Control of XT when Blow Out Preventer (BOP) is connected to the XT (i.e. so-called "XT control in BOP mode"),
- Emergency Disconnect Package (EDP)/Lower Riser Package (LRP) in open water,
- Riserless Light Well Intervention (RLWI).

It is described a subsea deployable installation and work-over control system (IWOCS) skid for connection to a subsea component, the skid comprising:

- a wireless communication unit for communication with a wireless communication unit at a topside installation;
- a control system for data storage and/or data filtering and transferring the filtered data to the wireless communication unit and receiving data from the wireless communication unit;
- a self-contained fluid system comprising a fluid supply tank, the fluid system being configured to be connected to a fluid connection on the subsea component such as to provide fluid to the subsea component;
- an electric power source for supplying electric power to the communication unit and the control system.

The term self-contained, or self-supplied, fluid system means that there are no fluid-lines between the tool and the topside installation after deployment of the skid.

The control system can be designed for storage of data subsea, processing and/or buffering data and to filter specific data to the topside installation. This is particularly advantageous when using wireless communication in water due to limited bandwidth (and consequently limited amount of data which can be transferred topside).

The storage of data may be performed such that the data can be read once the skid and controller is retrieved topside.

The communication unit and the control system are the minimum of elements which needs to be powered by the electric power source, provided the self-contained fluid system are accumulators and that the valves opening and closing the accumulators is part of the control system.

The electric power source is not limited to powering the communication unit and the control system, but may also provide power to other elements such as to drive a pump or other element or equipment requiring power.

In one embodiment it may be an electric communication/charging cable between the topside installation and the communication unit on the skid.

The IWOCS skid may be installed directly on the seabed if possible, or a mud mat may form a base for the IWOCS skid.

The wireless communication unit on the skid may comprise an acoustic transponder for communication with an acoustic transponder topside. This renders possible operation by/from the skid on the subsea component without any connections between the skid and the topside installation. If acoustic transponder(s) are used, they may have one or more of the following properties: speed in water e.g. 1500 m/s, typically 2400 bit/s simplex, suitable battery on skid (e.g. lithium which may be rechargeable).

The skid may further comprise a pump unit for pressurizing fluid fed from the self-contained fluid system to obtain control of the well. Such subsea usable pump units are known to the skilled person and will not be described in greater detail herein.

The fluid supply tank may comprise a hydraulic fluid.

The fluid supply tank may comprise a chemical injection fluid. The chemical injection may be used instead of hydraulic fluid or in addition to hydraulic fluid. Typically, the chemical injection fluid is Mono Ethylene Glycol (MEG) which is often used subsea in order to prevent formation of hydrates in the elements subsea.

The skid may further comprise a return tank for collecting spent fluid, such as hydraulic fluid. The return tank can thus be a hydraulic fluid return tank. This forms a closed system in that e.g. hydraulic fluid is supplied from the fluid system to the well and returned to the return tank where it is collected before being retrieved back to the topside installation. Hence, the return tank is not in communication with the hydraulic fluid storage tank.

Alternatively, if water-based hydraulic fluid is used, and if a return tank is not used, spent hydraulic fluid can be dumped to sea. This embodiment does not require a return tank.

The electric power source may comprise a battery. The battery may e.g. be a chargeable battery and/or a battery with a capacity of operating the equipment on the skid for a predetermined time. The predetermined time may be hours, days and even weeks.

If a longer operation time is expected, it may be possible to provide a permanent or temporary electrical cable between the topside installation and the battery for charging of the battery.

If using batteries arranged on the IWOCS skid, the batteries may be charged via fixed electrical cable to the floating installation, or it may be temporary charged via cables carried by a ROV.

The electric power source may comprise a fuel cell for generating electric power subsea. This solution makes it possible to produce power when needed. May be done by bringing down O2 and H2 tanks to generate electric power. In addition, if the tanks are relatively small, the overall size of the power source may be limited contributing to reduced size and weight of the skid.

The control system may operate at least partly autonomous. This means that the control system may operate according to pre-programmed algorithms in the event of specific communication signals and/or detections made by the control system. Partly autonomous is thus that the control system can act on its own/independently when receiving or detecting specific signals.

The system may comprise an additional or redundant communication system. The additional or redundant communication system can be cabled or acoustic. If the "primary communication system" is acoustic operating on a specific first frequency, the redundant acoustic system can communicate using a second frequency, which second frequency is different from the first frequency.

The skid, e.g. the control system of the skid, may comprise a means for switching functionality between the wireless communication unit and the additional communication system. The means for switching can be a switch or it can be a function in the control system on the skid.

The additional communication system may comprise a wireless communication unit for communication with a wireless communication unit on a Remotely Operated Vehicle (ROV). Shorter wireless distance, i.e. wireless communication between skid and ROV instead of between skid and topside installation, renders possible higher bandwidth. This solution utilizes the communication/power cable already present between the ROV and the topside installation as the ROV is always wired/cabled to a topside installation.

Alternatively, the additional communication system may be an ROV docked to the skid. This solution utilizes the communication/power cable already present between the ROV and the topside installation as the ROV is always wired/cabled to a topside installation. The cable enables the possibility of high-bandwidth communication as well as charging of the power source (battery). This may be advantageous as stored filtered data in the control system may be transferred via high bandwidth to the topside installation through the ROV cable(s).

Alternatively, the additional communication system is a communication line or an electrical line from the skid to an ROV. This solution utilizes the communication/power cable already present between the ROV and the topside installation as the ROV is always wired/cabled to a topside installation. The line or cable is typically laid by a ROV. This line may be used e.g. if the wireless communication is lost or if a large amount of data shall be transferred either form the skid to the topside installation or from the topside installation to the skid.

Alternatively, when the skid has been deployed and installed at a subsea location, the additional communication system may be a connection to a preinstalled communication line present at the subsea location at or close to the subsea component. Hence, in this solution, infrastructure already present at the subsea location is used for providing the additional communication system and/or power supply. An example of already present infrastructure can be e.g. a floating platform connected to a X-mas tree subsea where the skid is connected to cables or wires subsea. This may be advantageous as stored filtered data in the control system may be transferred via high bandwidth to the topside installation through the already present cable(s).

The additional power supply may be an ROV docked to the skid. The additional power supply enables the possibility of redundant power supply in case the power supply on the skid fails and/or is depleted, or the possibility of charging the power supply on the skid.

The additional power supply may be an electrical line from the skid to an ROV. The electrical line can be any line providing the required function may be used, such as, but not limited to, coax cable, optic cable, fiber cable, fiber optic cable etc. for charging of the power source, such as battery.

Alternatively, when the skid has been deployed and installed at a subsea location, the additional power supply may be a connection to a preinstalled power line present at the subsea location at or close to the subsea component.

Required topside equipment is provided on the floating topside installation, which may include, but is not limited to Human Machine Interface (HMI), Ethernet/OPC, Router board, acoustic transponder, ROV Multiplexer, ROV cables and docking station.

The system is preferably equipped with required equipment to operate the hydraulics locally while on seabed, i.e. via the self-contained fluid system.

It is further described a method of performing installation or workover operation(s) on a subsea component using an installation workover control system (IWOCS) skid, the skid comprising a wireless communication unit for communication with a wireless communication unit at topside installation; a control system for data storage and/or data filtering and transferring the filtered data to the wireless communication unit and receiving data from the wireless communication unit; a self-contained fluid system comprising a fluid supply tank, the fluid system being configured to be connected to a fluid connection on the subsea component such as to provide fluid to the subsea component; an electric power source for supplying electric power to communication unit and the control system; the method comprising the steps of:

deploying the skid to a location subsea;

connecting the fluid system to the subsea component; and performing work on the subsea component utilizing the fluid system.

The control system can be designed for storage of data subsea, processing and/or buffering data and to filter specific data to the topside installation. This is particularly advantageous when using wireless communication in water due to limited bandwidth (and consequently limited amount of data which can be transferred topside).

The storage of data may be performed such that the data can be read once the skid and controller is retrieved topside.

The method may comprise deploying the skid using a crane or other suitable means such as on wire/wireline or on coiled tubing.

The wireless communication unit may comprise an acoustic transponder for communication with an acoustic transponder topside, and the method may comprise a step of:

controlling the skid from the topside installation via communication between the acoustic transponder topside and the acoustic transponder on the skid.

The step of establishing an additional communication to the skid may comprise:

deploying a ROV subsea, wherein the ROV comprises a wireless communication unit, communicating with the topside installation via the wireless communication unit on the ROV and the wireless communication unit on the skid.

The step of establishing the additional communication system and/or the additional power supply to the skid may comprise docking a ROV to the skid.

The step of establishing the additional communication system and/or the additional power supply to the skid may comprise connecting an electrical line between an ROV and the skid.

Alternatively, when the skid has been deployed and installed at a subsea location, the step of establishing an additional communication to the skid may comprise:

connecting the skid to a preinstalled communication and power supply system present at a subsea location at or close to the subsea location of the skid.

The control system may be configured for partly autonomous operation comprising:

receiving communication signals or detect signals and thereby perform a required action in accordance with pre-programmed algorithms in the event specific communication signals and/or other signals are detected. The signals may e.g. be detected in-situ or be an input from elements or equipment on the skid.

The required action may be to filter said detected signals and communicate the filtered signals to the topside installation.

These and other characteristics of the invention will be apparent from the enclosed drawings, wherein;

BRIEF DESCRIPTION OF THE DRAWINGS

FIG. 2A is a perspective view of the skid with outer cover, seen from a first side, FIG. 2B is a perspective view of the skid with outer cover, seen from a second side opposite to the first side;

FIG. 2C is a similar view as in FIG. 2A where the outer covers have been removed in order to see the different components the skid may comprise as well as the mutual arrangement of the different components;

FIG. 2D is a similar view as in FIG. 2B where the outer covers have been removed in order to see the different components the skid may comprise as well as the mutual arrangement of the different components;

FIG. 2E shows a top part of the outer cover of the skid;

FIG. 2F is a similar view as in FIG. 2A where the different components of the skid have been removed in order to better illustrate the outer side cover of the skid;

FIG. 2G is a similar view as in FIG. 2B where the different components of the skid have been removed in order to better illustrate the outer cover of the skid;

DETAILED DESCRIPTION OF THE INVENTION

Figure 1:
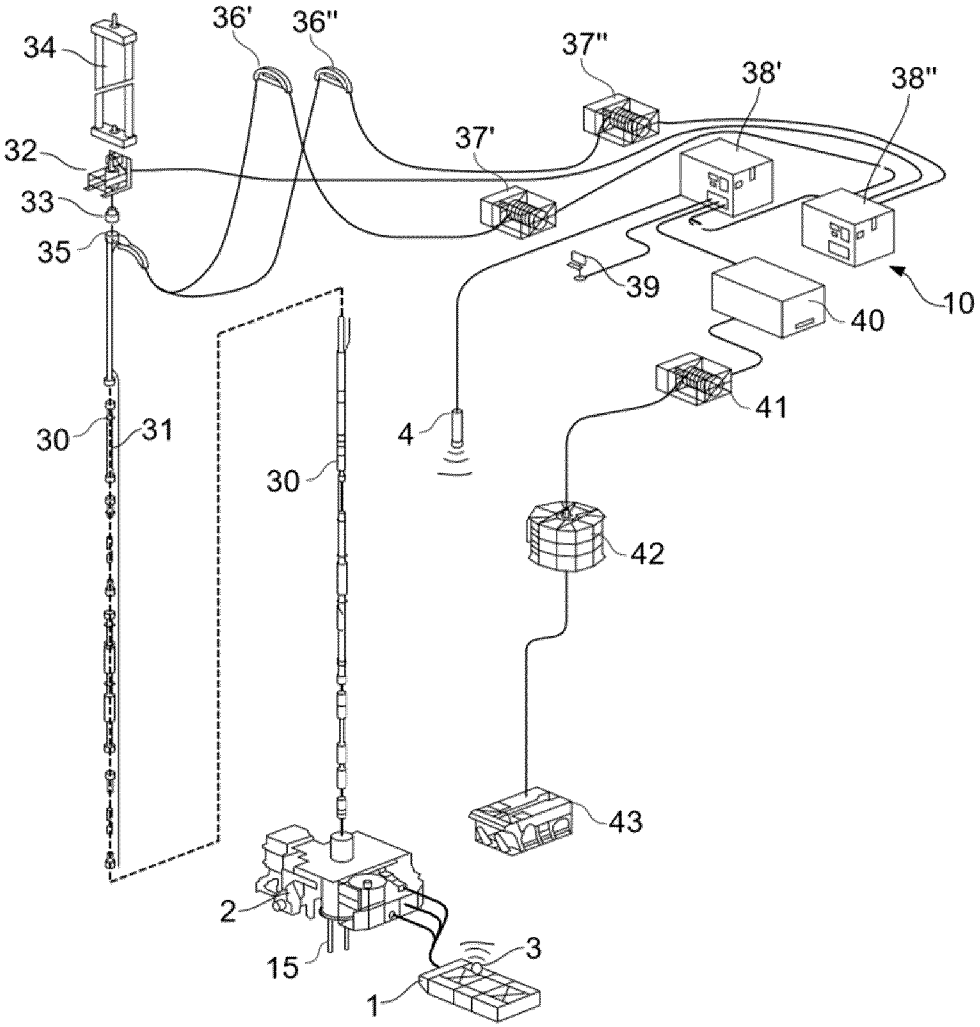
FIG. 1 is an overall view of an umbilical-less XT control, where the communication between an IWOCS skid subsea and topside is via acoustic transponders arranged on the skid and topside, respectively.

In the following, embodiments of the invention will be discussed in more detail with reference to the appended drawings. It should be understood, however, that the drawings are not intended to limit the invention to the subject-matter depicted in the drawings. Furthermore, even if some of the features are described in relation to the subsea wellhead support system only, it is apparent that they are valid for the related method as well, and vice versa. Hence, any features described in relation to the method only are also valid for the subsea wellhead support system.

Referring to FIG. 1, an overall view of an umbilical-less XT control is disclosed, where the communication between an IWOCS skid 1 subsea and a topside installation 10 is via acoustic transponders arranged on a communication unit 3 on the skid 1 and a communication unit 4 at the topside installation 10, respectively. A riser 30 extends from the topside installation 10 with an umbilical 31 clamped thereon. The equipment forming part of the surface installation 10 may comprise:

surface flow tree 32, swivel 33, tension frame 34, gooseneck (tubing hanger mode) 35, HSLV sheave 36', LS sheave 36", HSLV umbilical and reel 37', LS umbilical and reel 37", Master control systems 38', 38" and IWOCS remote control panel 39. In addition, a ROV container 40 is arranged topside, which is connected to a ROV umbilical reel 41 which is connected to a tether management system (TMS) 42 which again is connected to a ROV 43. Appropriate fluid and communication lines are provided between the different equipment, as required.

The riser 30 is disclosed with typical components such as: extension joint(s), crossover joint(s), casing joint(s), lubricator valve(s), Landing string accumulator module (LAM) joint, slim line connection landing string umbilical, Landing string Subsea control module (LSCM), Riser Control Module (RCM), landing string adapter, Lower landing string (LLS) assembly, tubing hanger running tool, etc.

The skid 1 is configured to be connected to a fluid connection on the subsea component 2 such as to provide fluid to the subsea component and/or access to a well 15 in fluid communication with the subsea component 2.

Figure 2B:
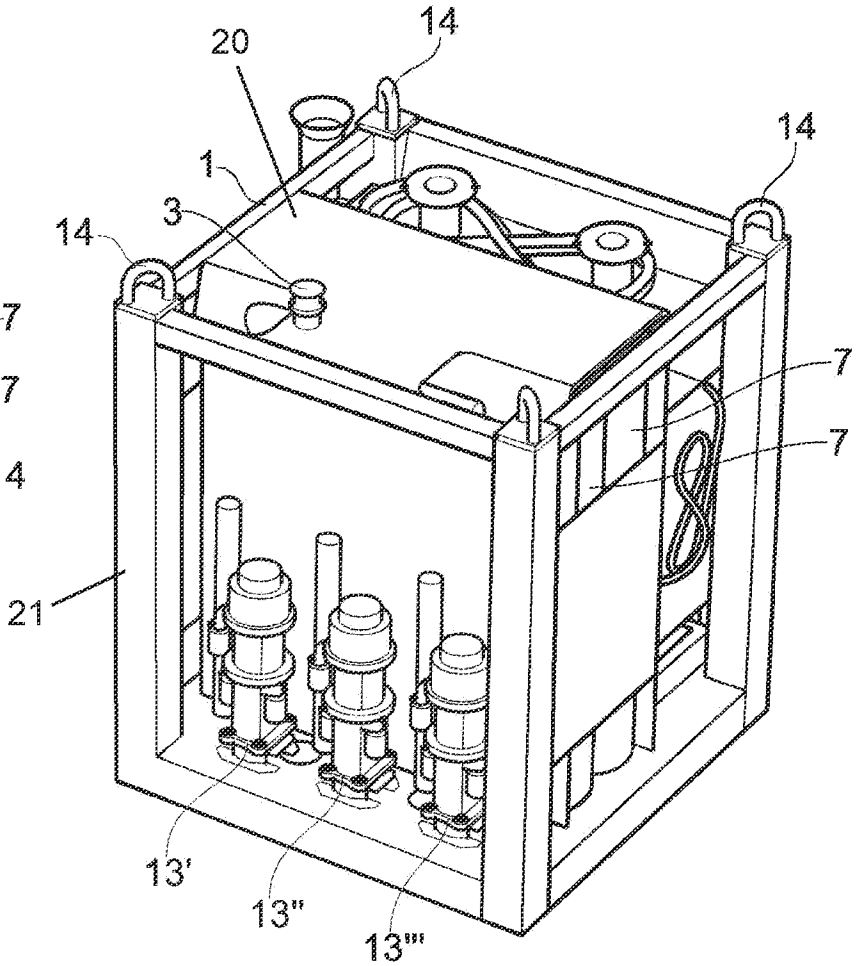
FIGS. 2A-2G are different views on an IWOCS skid according to the invention, where.
Figure 2A:
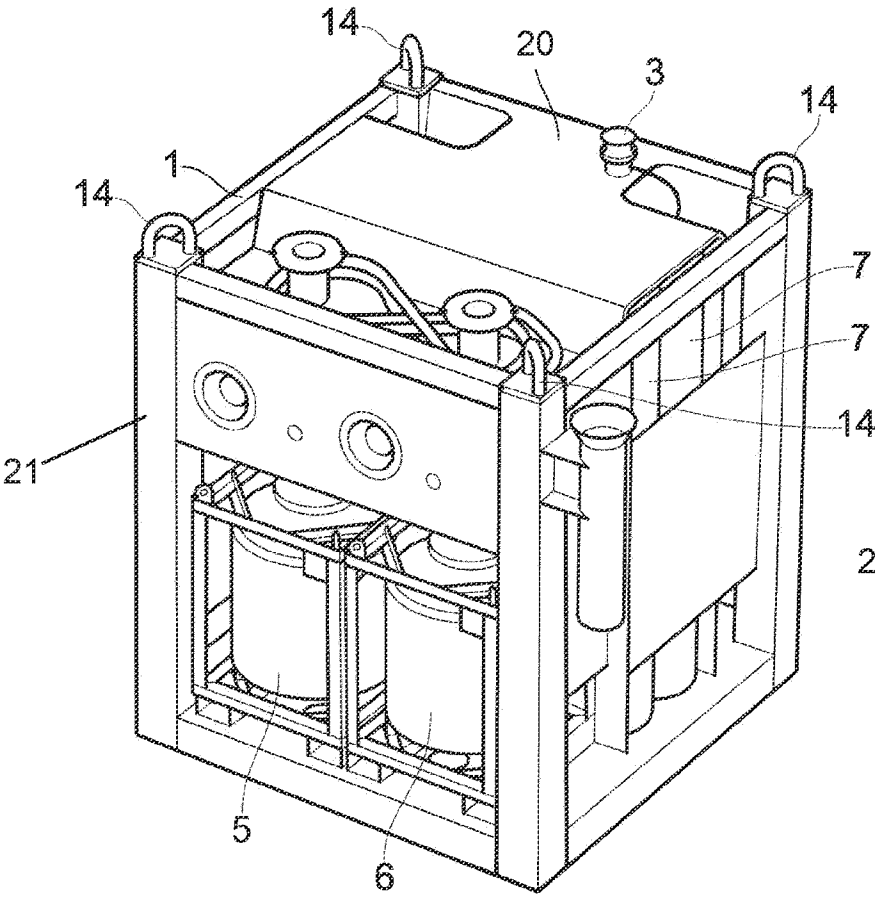

FIG. 2A is a perspective view of the skid 1 with outer cover, including top part cover 20 and side covers 21, seen from a first side. The skid 1 is disclosed having a total of four lifting hooks 14 in top corners for safe and stable installation subsea and retrieval to topside. A wireless communication unit 3 in the form of an acoustic transponder is disclosed in the top cover 21 of the skid 1. The acoustic transponder 3 may communicate with a wireless communication unit 4 in the form of an acoustic transponder at a topside installation 10 (see element 4 in FIG. 1). The skid 1 comprises a self-contained or self-sufficient fluid system comprising a hydraulic fluid supply tank 5. In addition, a hydraulic fluid return tank 6 for storing spent hydraulic fluid is disclosed next to the supply tank 5. The self-contained fluid system is connected to an electric power source 7 which provides electric power to the self-contained fluid system.

FIG. 2B is a perspective view of the skid 1 with outer covers, including top part cover 20 and side covers 21, seen from a second side opposite to the first side of FIG. 2A. In FIG. 2B the setup of low-pressure (LP) pump 13', high-pressure (HP) pump 13" and chemical pump 13'" is illustrated.

Figure 2D:
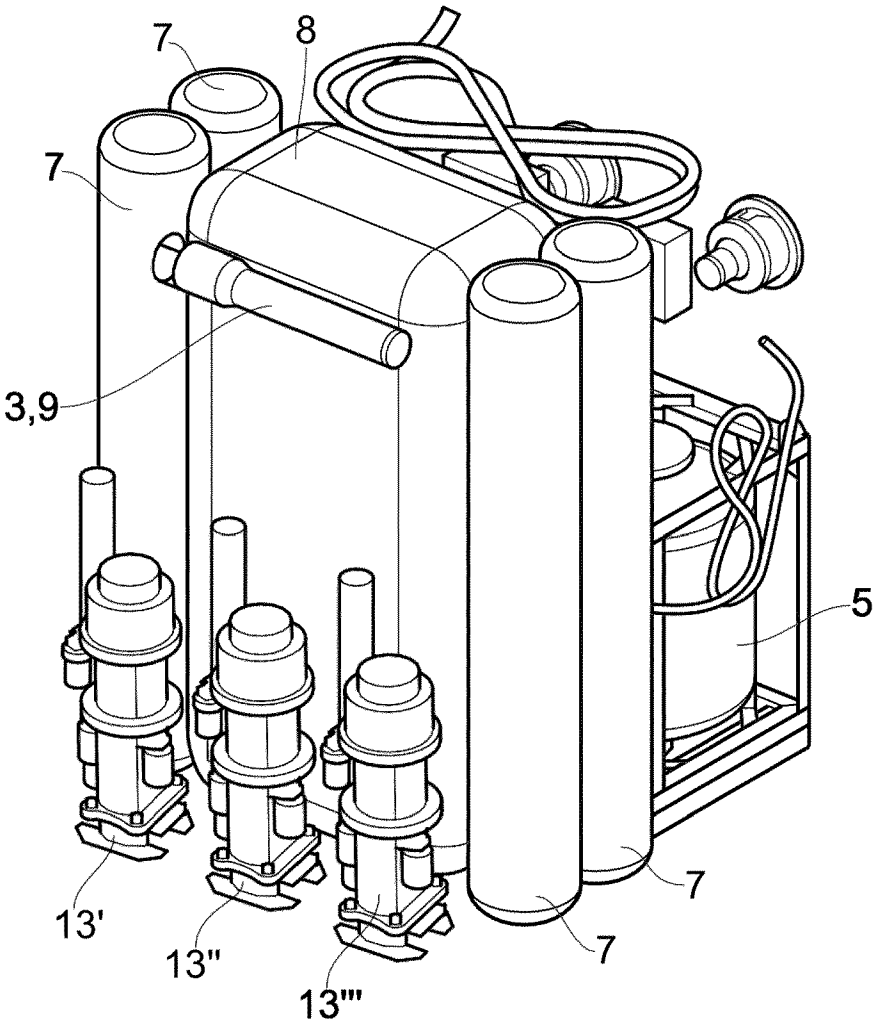
Figure 2C:
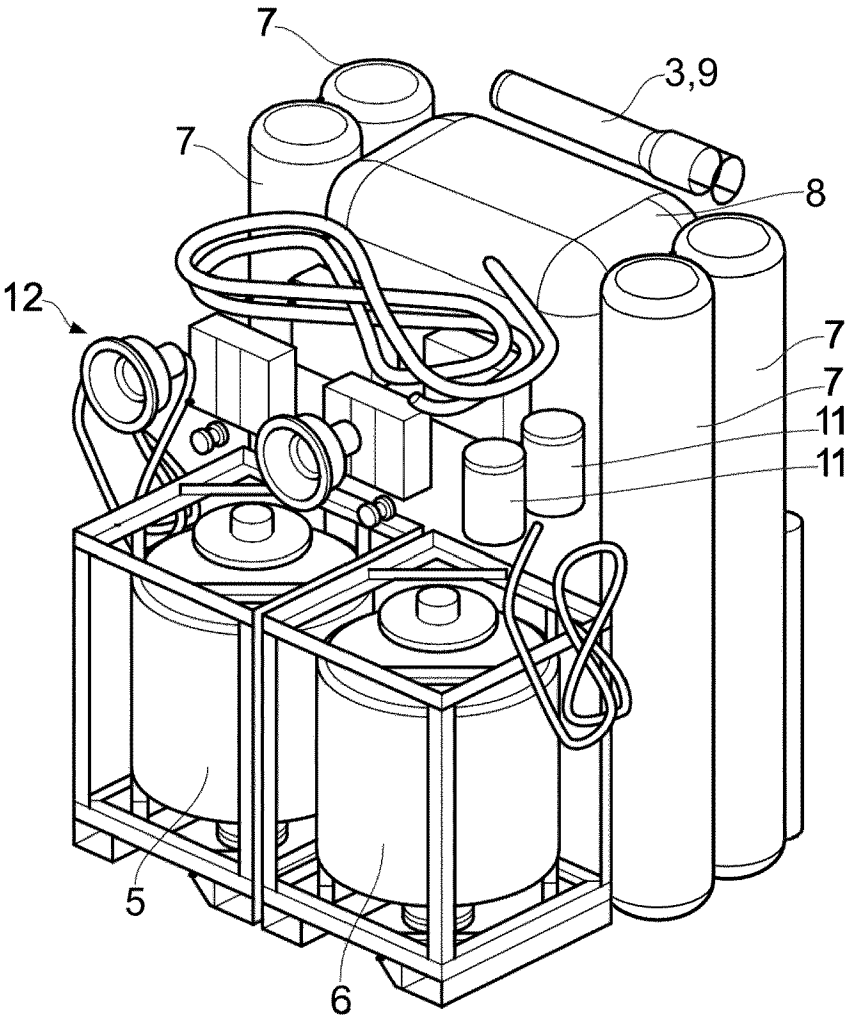

FIG. 2C is a similar view as in FIG. 2A where the outer covers 20, 21 have been removed in order to see the different components the skid 1 may comprise as well as the mutual arrangement of the different components. Comparing FIG. 2C with the components visible in FIG. 2A, one may in addition see two additional electric power sources 7, a tank 8 for storage of chemical injection fluid, an acoustic transponder 9, two subsea electronic modules (SEMs) 11 and valve pack 12. In addition, some communication and fluid lines between the different components are disclosed.

FIG. 2D is a similar view as in FIG. 2B where the outer covers 20, 21 have been removed in order to see the different components the skid 1 may comprise as well as the mutual arrangement of the different components.

Figure 2G:
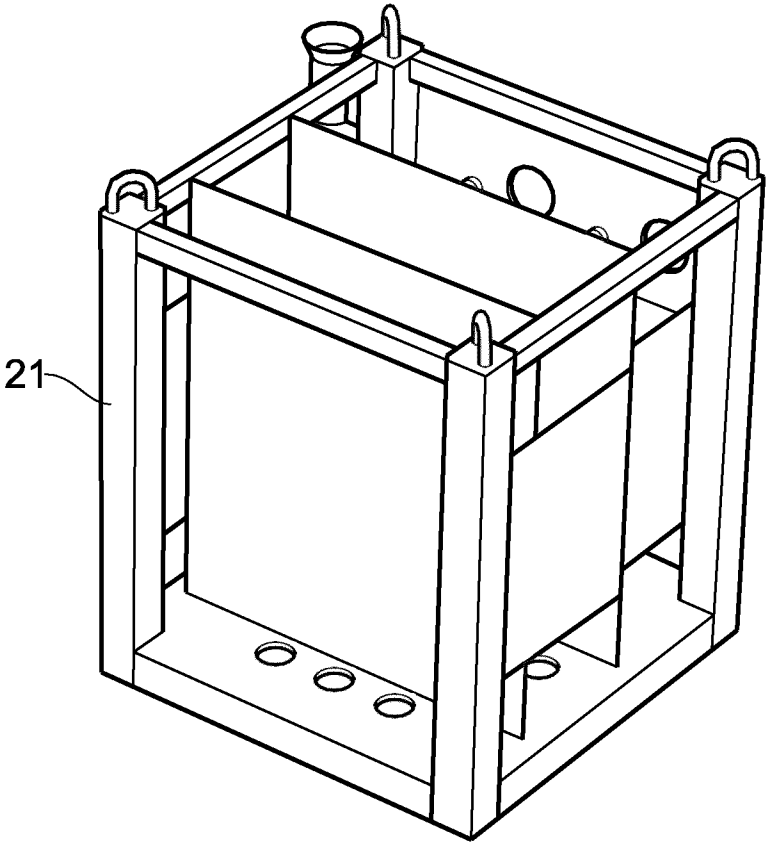
Figure 2E:
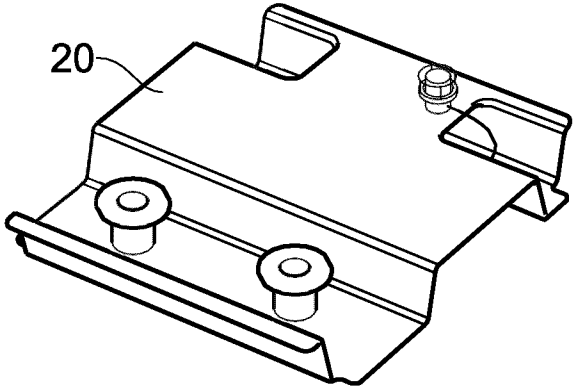

FIG. 2E shows a top part 20 of the outer cover of the skid 1.

Figure 2F:
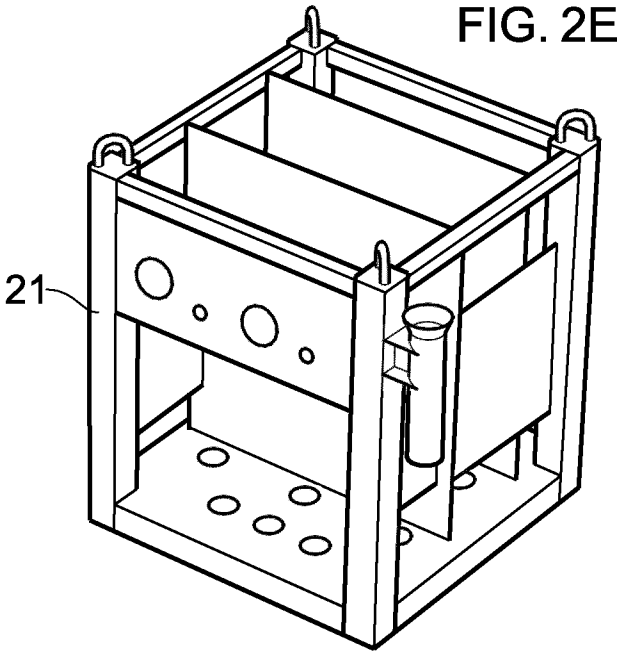

FIG. 2F is a similar view as in FIG. 2A where the different components of the skid 1 have been removed in order to better illustrate the outer side cover 21 of the skid.

FIG. 2G is a similar view as in FIG. 2B where the different components of the skid have been removed in order to better illustrate the outer side cover 21 of the skid.

Figure 3C:
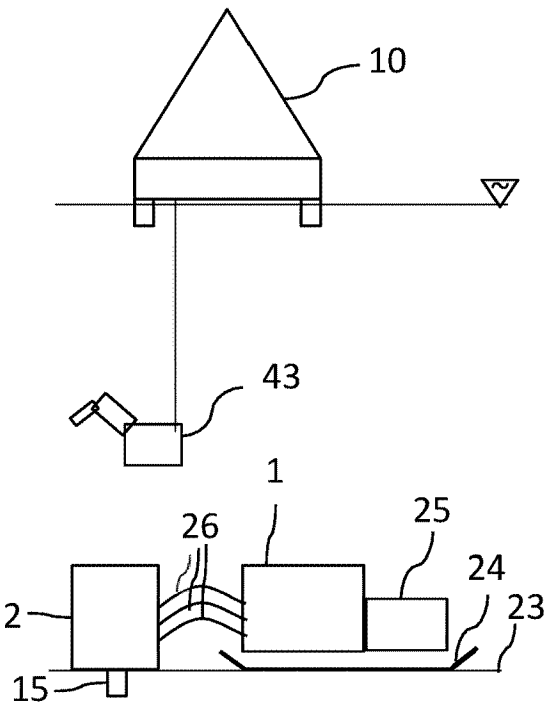
FIGS. 3A-3F show an example of different steps during installation of a horizontal XT.
Figure 3B:
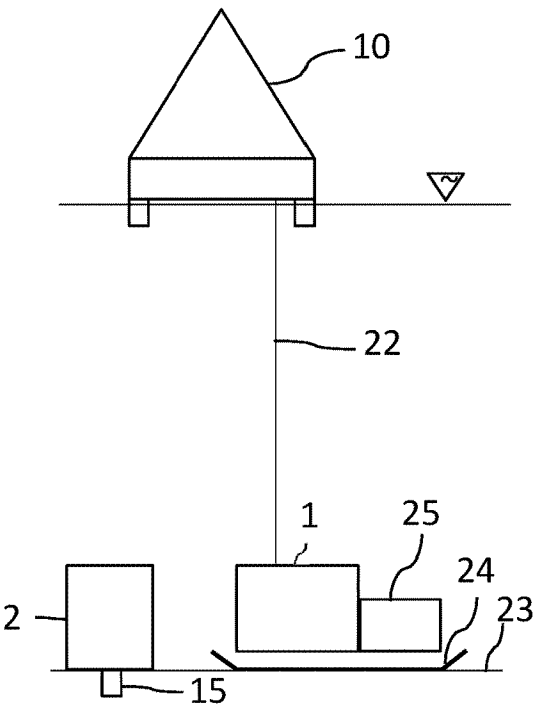
Figure 3A:
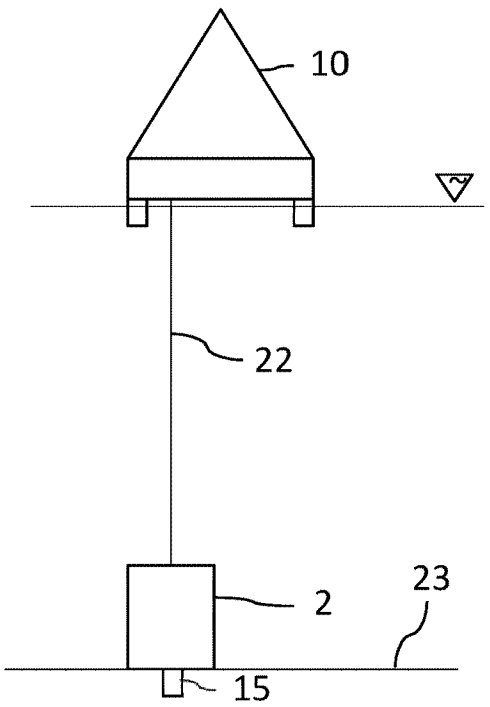

FIGS. 3A-3F show an example of different steps during installation of a subsea component 2 in the form of a horizontal XT (Xmas tree). Referring to FIG. 3A, a topside installation 10 in the form of a floating rig is disclosed. The XT 2 is run on wireline 22 from the floating rig 10 and down to seabed 23.

Referring to FIG. 3B, the IWOCS skid 1 is installed on wireline 22 and lowered onto a mudmat 24. In addition, the jumper basket 25 may be installed together with or next to the skid 1 on the mudmat 24. The mudmat 24 is only required if the seabed 23 is uneven and if it is difficult to provide a stable foundation for the skid 1 directly on the seabed 23.

Referring to FIG. 3C, flying leads 26 are installed between the IWOCS skid 1 and the XT 2 using a ROV 43.

Figures 3D, 3E, 3F:
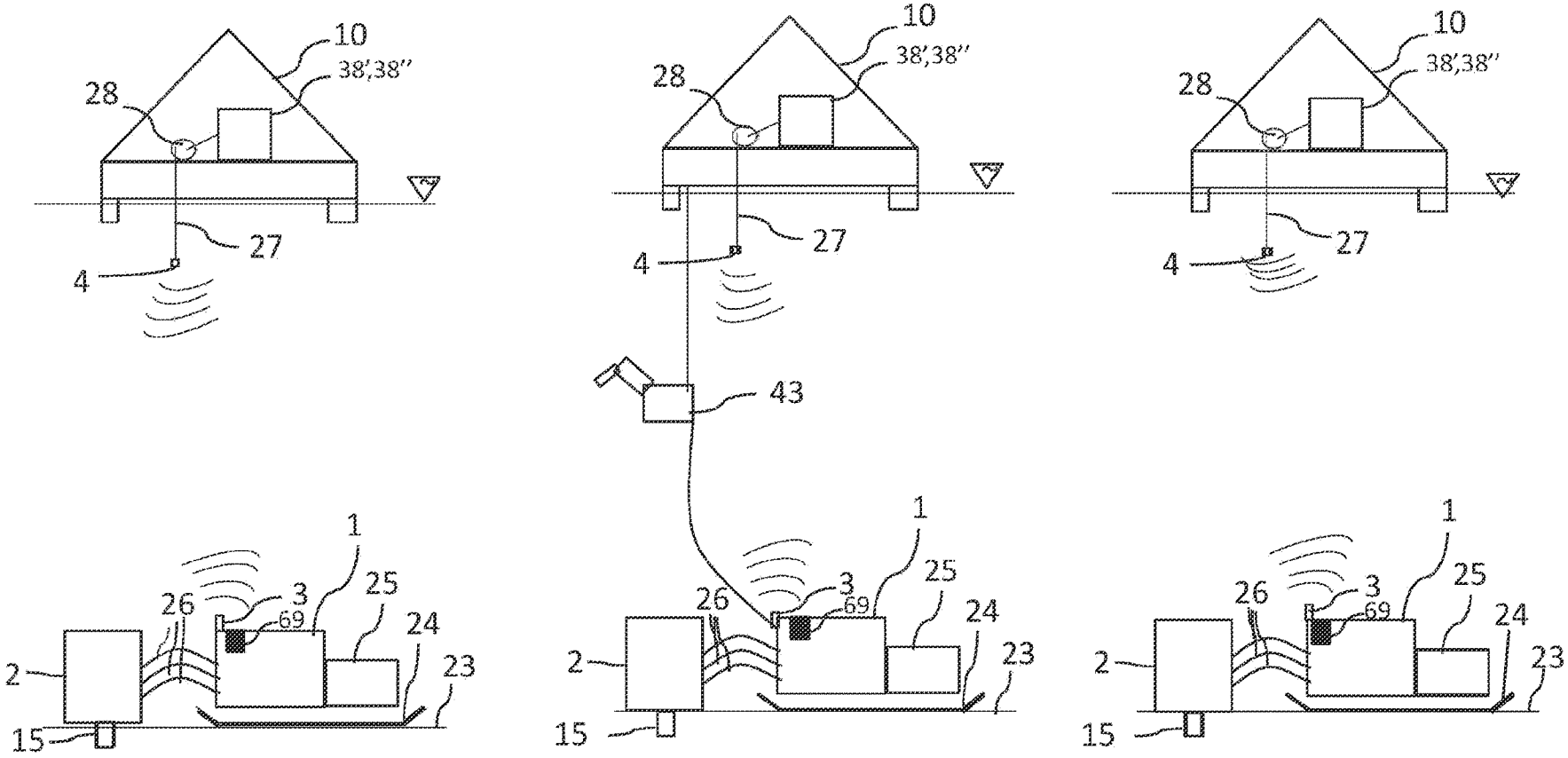

Referring to FIG. 3D, the ROV 43 has been retrieved to the topside installation 10. An acoustic transponder cable 27 suspended from an acoustic reel 28 and with a communication unit 4 in an end extending into the sea, have been prepared and installed on the topside installation. Other required topside controls such as master control systems 38', 38" has also been installed. The wireless communication unit 3 on the skid 1 has been activated (as indicated by the wave-shape) in direction towards the wireless communication unit 4 on the topside installation 10 and wireless/acoustic communication between the wireless communication units 3, 4 is established. A control system 69 with a processing unit for data storage and/or filtering of data and transferring the filtered data to the wireless communication unit 3 and receiving data from the wireless communication unit 3, is also shown as part of the skid 1.

Referring to FIG. 3E, an optional step of loading a XT subsea control module (XTSCM) configuration file using a ROV 43 is illustrated.

Referring to FIG. 3F, optional step of FIG. 3E has been performed and the ROV 43 has been retrieved. In FIG. 3F, the functioning of the system is tested. This may include to XT lock Torus connector, manifold hub connector and test XT valves, which are the final pressure test of the connector prior to operation. If the tests are successful, the system is ready for operation.

FIGS. 4A-4E show an example of different steps during installation of a tubing hanger in a subsea component 2 in the form of a horizontal XT.

Figure 4B:
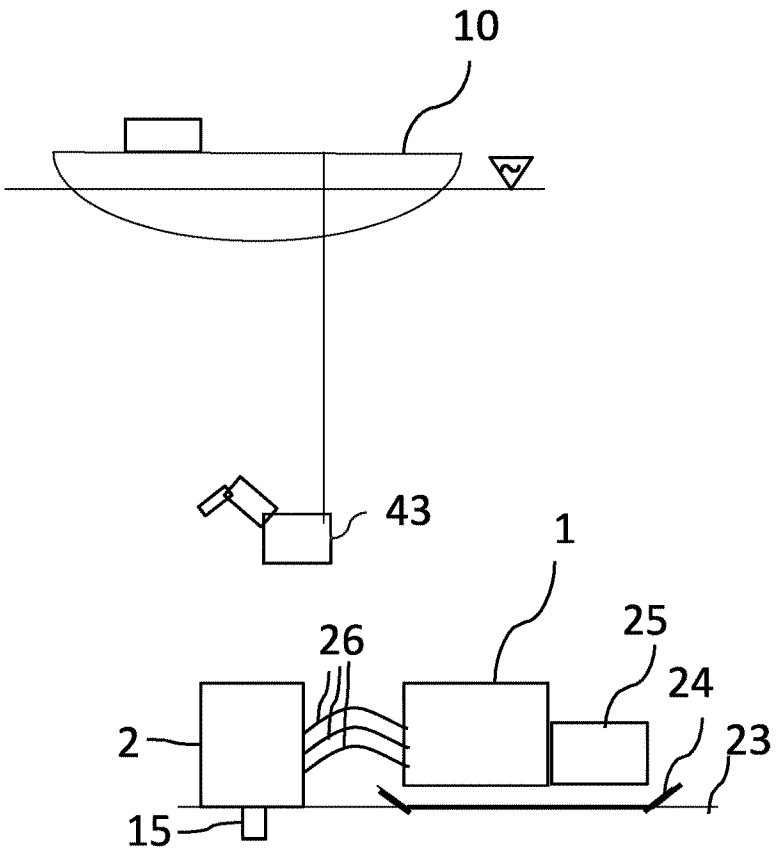
FIGS. 4A-4E show an example of different steps during installation of a tubing hanger in a horizontal XT, showing initial steps possible without a rig (i.e. pre-rig) and final steps with a rig.
Figure 4A:
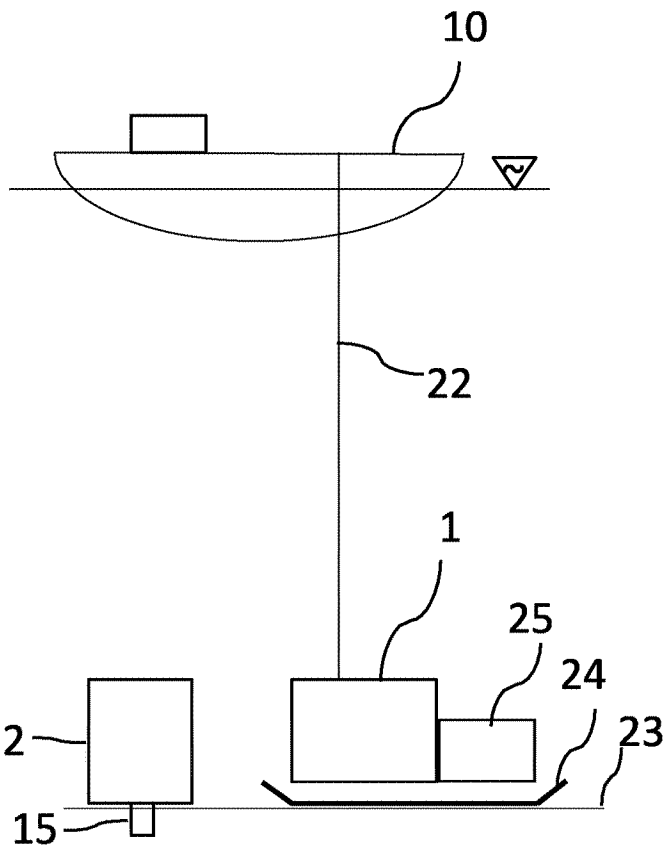

Referring to FIG. 4A, a situation pre rig is shown. The IWOCS skid 1 is installed on wireline 22 and lowered onto a mudmat 24. In addition, the jumper basket 25 may be installed together with or next to the skid 1 on the mudmat 24. The mudmat 24 is only required if the seabed 23 is uneven and if it is difficult to provide a stable foundation for the skid 1 directly on the seabed 23.

Referring to FIG. 4B, after installing the skid 1 in FIG. 4A, flying leads 26 between the skid 1 and the XT is installed using a ROV 43.

Figure 4D:
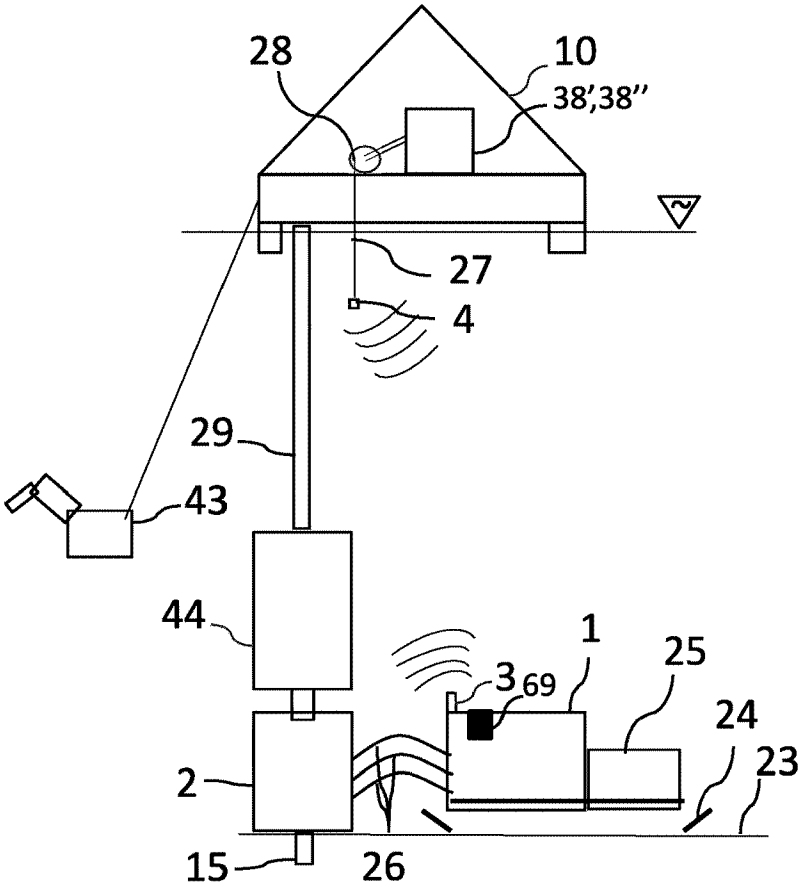
Figure 4C:
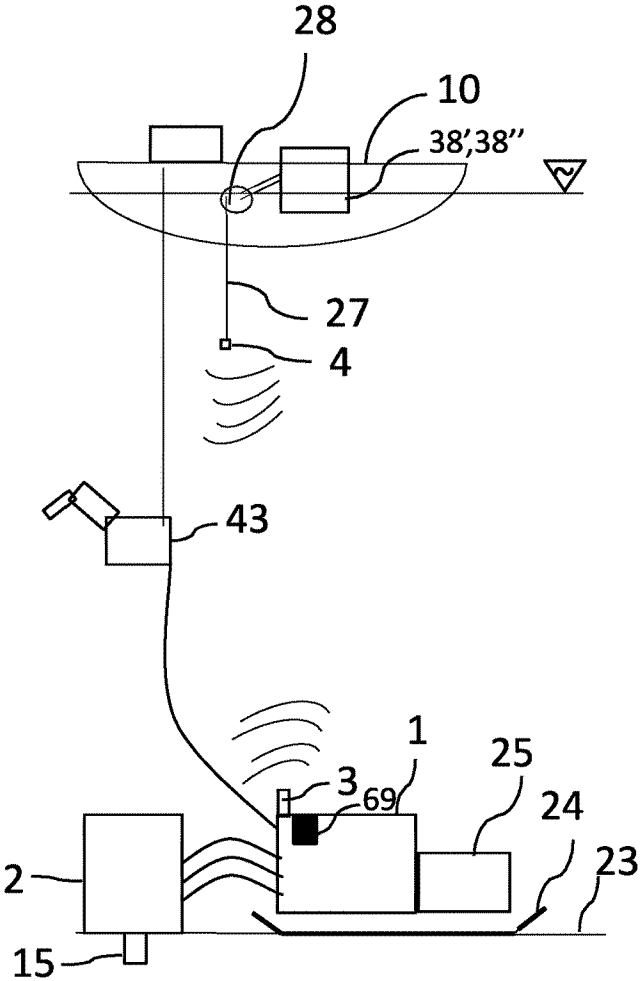

Referring to FIG. 4C, an optional pre-rig step of loading XT subsea control module (XTSCM) configuration file is shown. An acoustic transponder cable 27 suspended from an acoustic reel 28 and with a wireless communication unit 4 in an end extending into the sea, have been prepared and installed on the topside installation. Other required topside controls such as master control systems 38', 38" has also been installed. The wireless communication unit 3 on the skid 1 has been activated (as indicated by the wave-shape) in direction towards the wireless communication unit 4 on the topside installation 10 and wireless/acoustic communication between the wireless communication units 3, 4 is established. A control system 69 with a processing unit for data storage and/or filtering of data and transferring the filtered data to the wireless communication unit 3 and receiving data from the wireless communication unit 3, is also shown as part of the skid 1

Referring to FIG. 4D, the vessel 10 has been exchanged with a rig 10 in order to install a landing string 29. The installation of the subsea components has been performed in FIGS. 4A-4C. A blowout preventer (BOP) 44 is installed on top of the XT 2 using a landing string 29. An ROV 43 is used for observing the installation of the BOP 44. Once installed, the XT 2 is operated and the XT valves are tested.

Figure 4E:
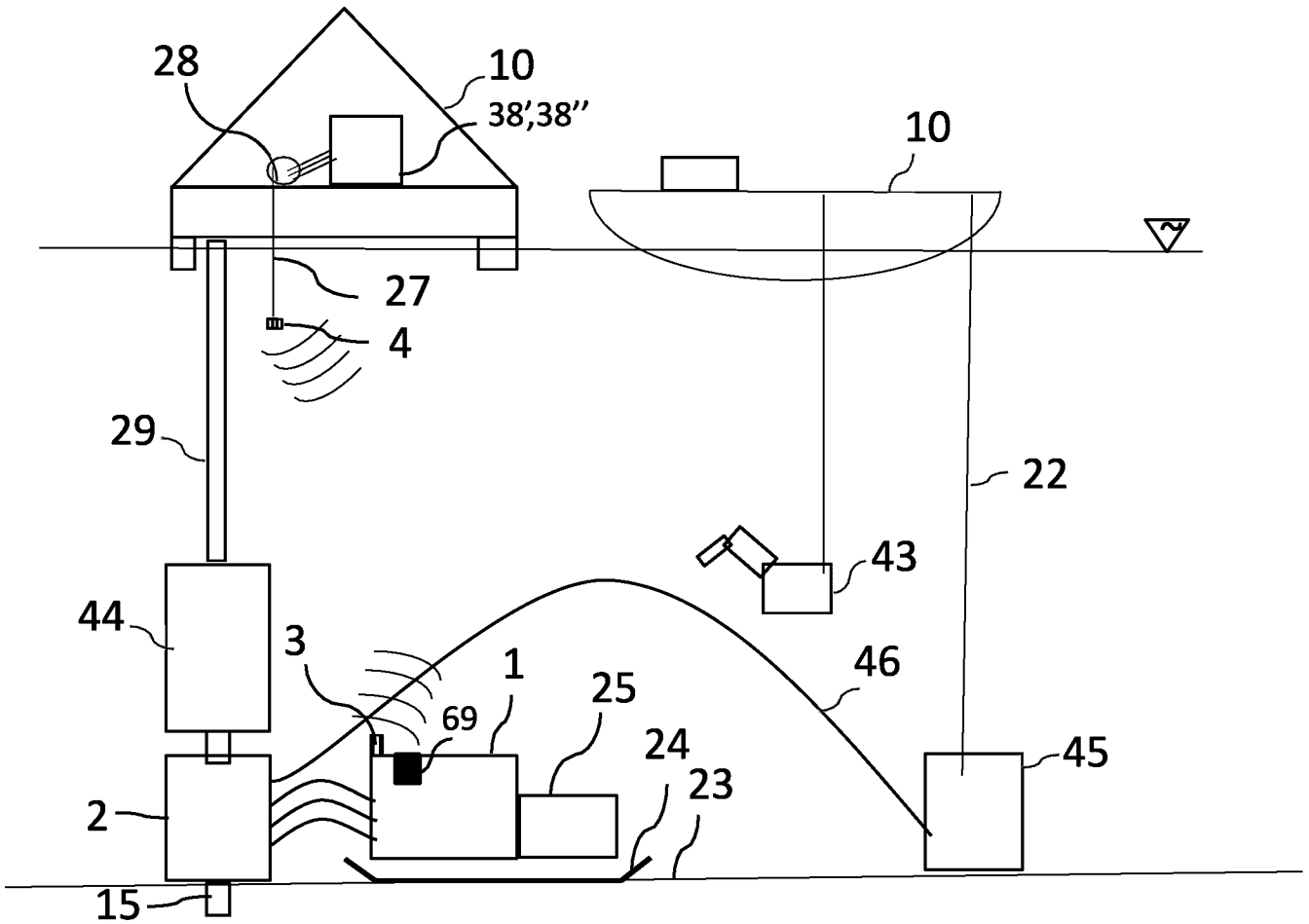

Referring to FIG. 4E, an optional step of hydrate remediation using a hydrate remediation skid 45 deployed from a separate vessel 10 using e.g. a wireline 22 is shown. The hydrate remediation skid 45 is connected to the XT 2 using a ROV 43 via line 46.

Figure 5:
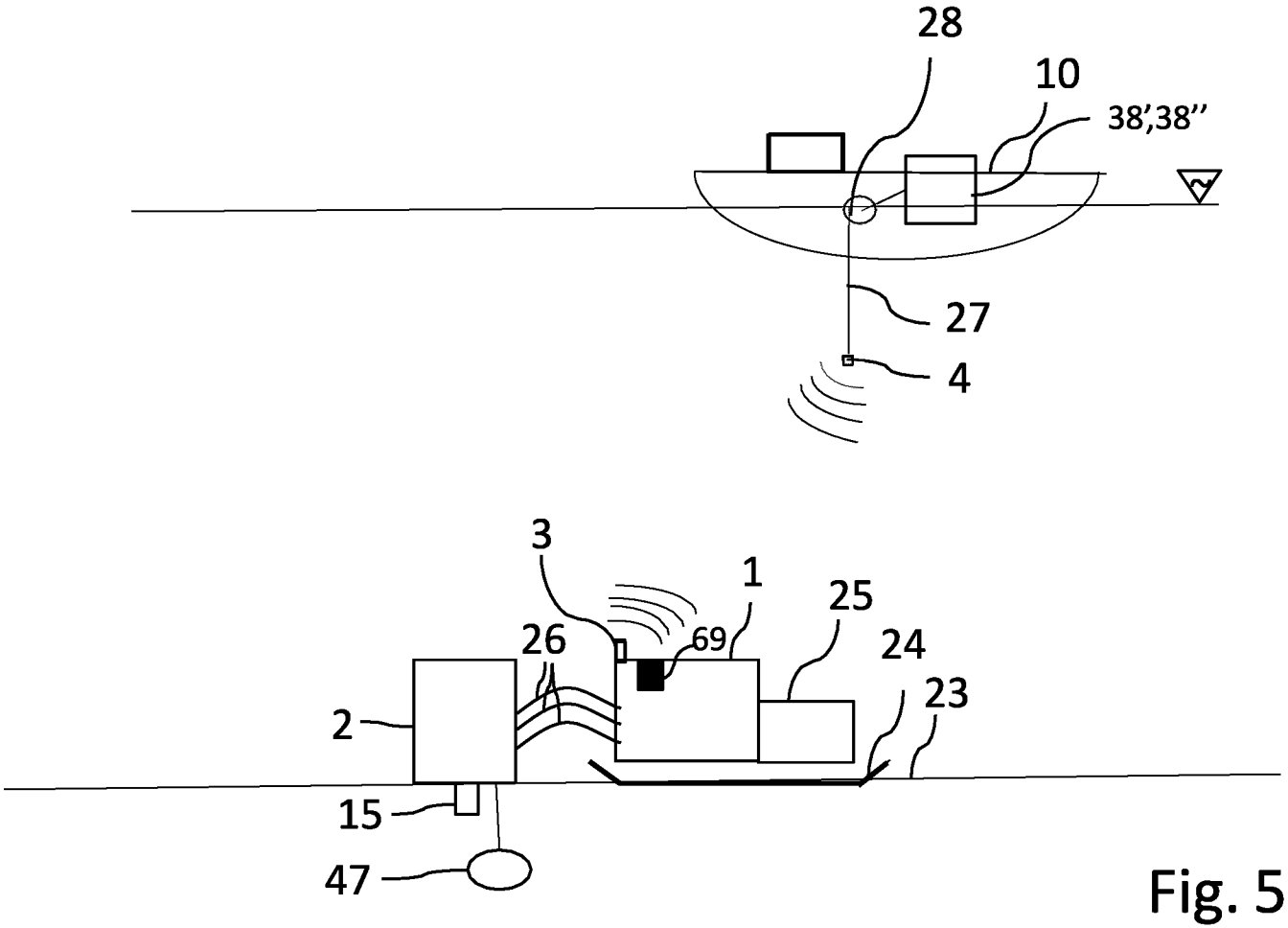
FIG. 5 shows an example of monitoring downhole instrumentation and XT and operation of subsea control module of XT using a vessel (i.e. not a rig)

FIG. 5 shows an example of monitoring downhole instrumentation 47 and XT 2 from a vessel 10. The monitoring is by wireless communication units 3,4 in the form of acoustic transponders, where one of the acoustic transponders 3 is arranged on the skid 1 and the other acoustic transponder 4 is arranged at the vessel 10. A control system 69 with a processing unit for data storage and/or filtering of data and transferring the filtered data to the wireless communication unit 3 and receiving data from the wireless communication unit 3, is also shown as part of the skid 1.

Figure 6:
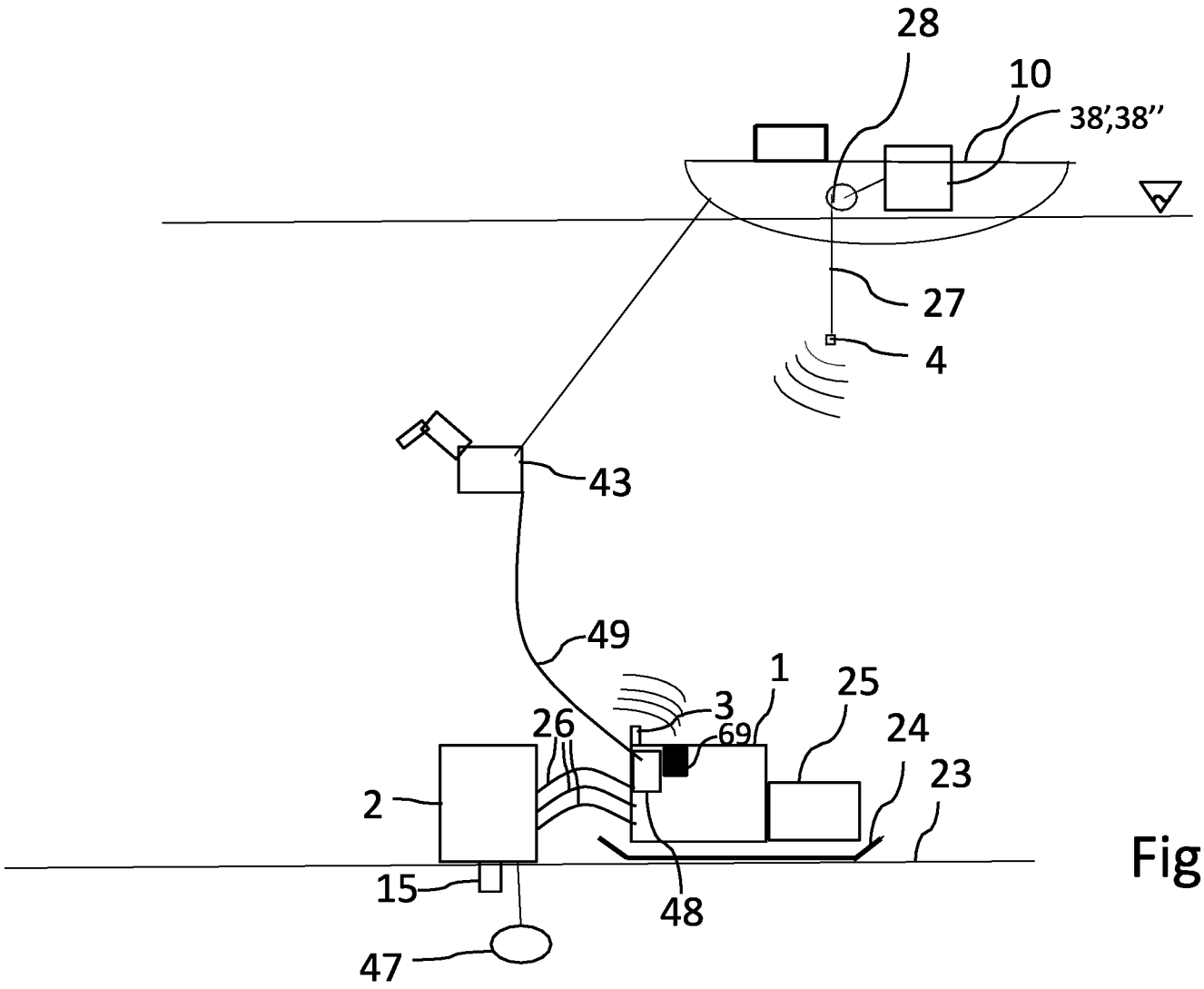
FIG. 6 shows an example of an additional communication system and additional power supply in the form of an electrical line between an ROV and the skid, e.g. how a battery on a skid may be charged by arranging an electrical line from a floating topside installation to the battery on the skid.

FIG. 6 shows an example of an additional communication system and additional power supply in the form of a communication line or electrical line 49 between an ROV 43 and the skid 1, e.g. how a battery 48 on a skid 1 may be charged by arranging an electrical line 49 from a floating topside installation 10 to the battery 48 on the skid 1. This option may be favorable in situations where the battery has depleted significantly or completely before all required operations have been finished. The communication line or electrical line 49 may also be used as an additional communication system for communicating with the skid 1. This line 49 may be used e.g. if the wireless communication is lost or if a large amount of data shall be transferred either from the skid 1 to the topside installation 10 or from the topside installation 10 to the skid. A control system 69 with a processing unit for data storage and/or filtering of data and transferring the filtered data to the wireless communication unit 3 and receiving data from the wireless communication unit 3, is also shown as part of the skid 1.

Figure 7:
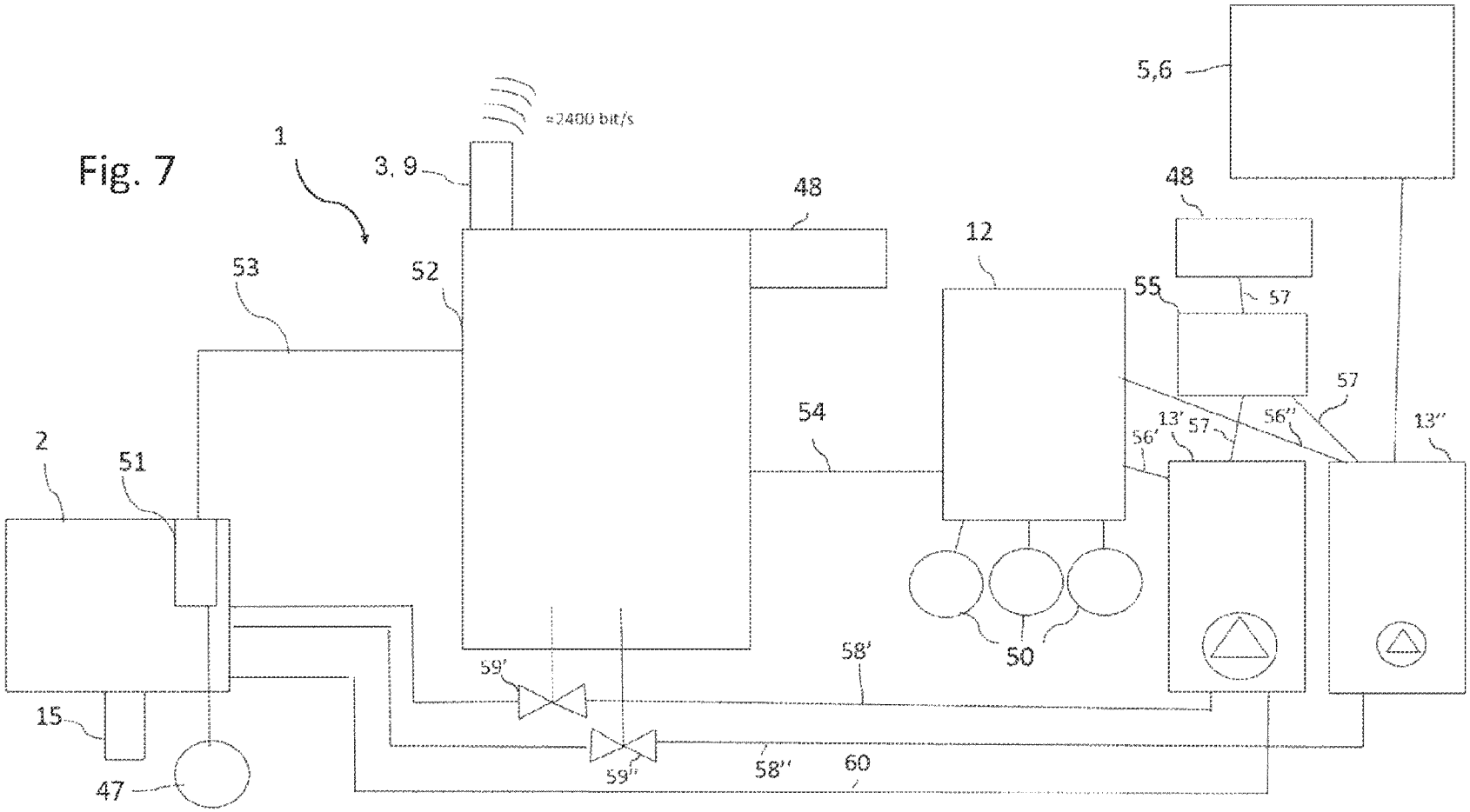
FIG. 7 is a schematic diagram of connections between the different equipment on an IWOCS skid with acoustic communication with the topside floating installation.

FIG. 7 is a of schematic diagram showing the connections between the different equipment on an IWOCS skid 1 with acoustic communication with the topside floating installation. The schematic diagram is thus an example of the relationship between the different components on an IWOCS skid 1.

A subsea control module (SCM) 51 on the XT 2 is connected to XT com/power canister 52 via a signal cable 53, which signal cable 53 provides the XT 2 with power and signal. The acoustic transponder 9 (i.e. communication unit 3) for communication with an acoustic transponder on the topside installation (not shown) is connected to the XT com/power canister 52. A battery 48 powers the XT com/power canister 52.

A valve pack 12 is in communication with the XT com/power canister 52 via a communication line 54. The valve pack is further in communication with a low-pressure pump 13' and a high-pressure pump 13" via separate lines 56', 56", respectively. A battery 48 may power the low-pressure pump 13' and the high-pressure pump 13" via a variable frequency drive 55. Power from the battery 48, via the variable frequency drive 55, to the pumps 13', 13" are submitted through power lines 57.

The low-pressure pump 13' is in communication with the XT 2 via low-pressure supply line 58'. A low-pressure quick dump valve (QDV) 59' is arranged in the low-pressure supply line 58'. Similarly, the high-pressure pump 13" is in communication with the XT 2 via high-pressure supply line 58". A high-pressure quick dump valve (QDV) 59" is arranged in the high-pressure supply line 58".

In addition, hydraulic test and function line(s) 60 may be arranged between low-pressure pump 13' and/or the high-pressure pump 13" and the XT 2.

The valve pack 12 may be in communication with a variety of monitoring devices 50 such as flow meter, pressure transmitter, temperature transmitter, level transmitter etc.

Figure 8:
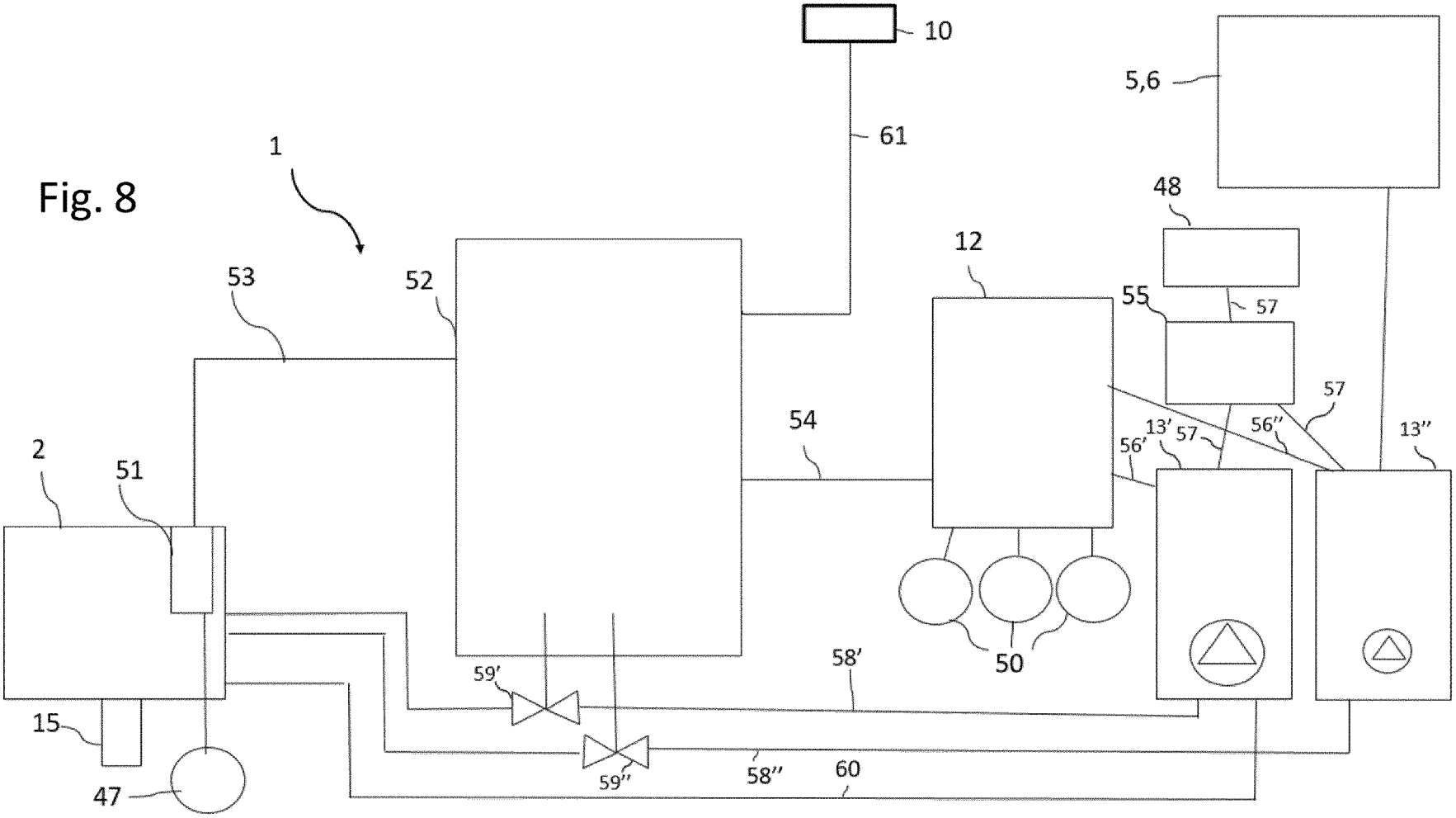
FIG. 8 is a schematic diagram of connections between the different equipment on an IWOCS skid with an electrical cable for communication with the topside floating installation.

FIG. 8 is a schematic diagram showing the connections between the different equipment on an IWOCS skid with an electrical cable 61 for communication with the topside floating installation. The setup of the components in FIG. 8 is similar to the setup in FIG. 7, except that the acoustic transponder 3,9 and the batteries 48 supplying power to the XT com/XT canister 52 and the low and high-pressure pumps 13',13", respectively, have been replaced by an electric cable 61 to the topside installation 10. Electric power and communication signals are thus transmitted via the electric cable 61 to the different components on the skid 1.

Figure 9:
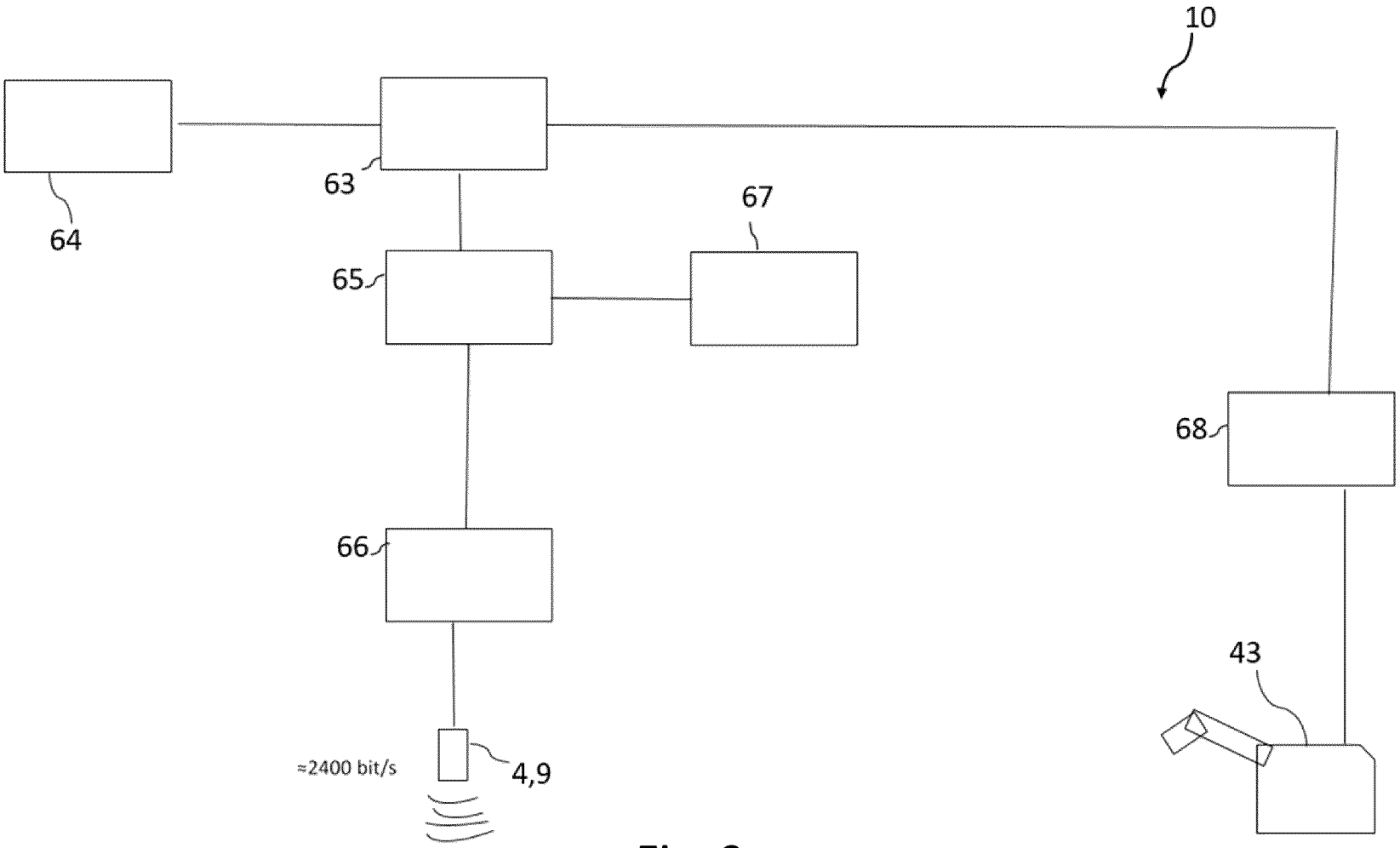
FIG. 9 is a schematic diagram of a possible setup of a topside control system with acoustic communication with the IWOCS skid.

FIG. 9 is a schematic diagram showing a possible setup of a control system on the topside installation 10 communicating acoustically with the IWOCS skid 1. Such setup may include a Human Machine Interface (HMI) 64, a computer protocol (e.g. Ethernet/OPC) 63, router board 65, a converter 66, acoustic transponder 4,9 communicating with acoustic transponder 3 on the skid (not shown), PC 67 (e.g. Innova PC with output and service and diagnostic input). The setup further comprises a ROV multiplexer 68 connected to the ROV 43.

Figure 10:
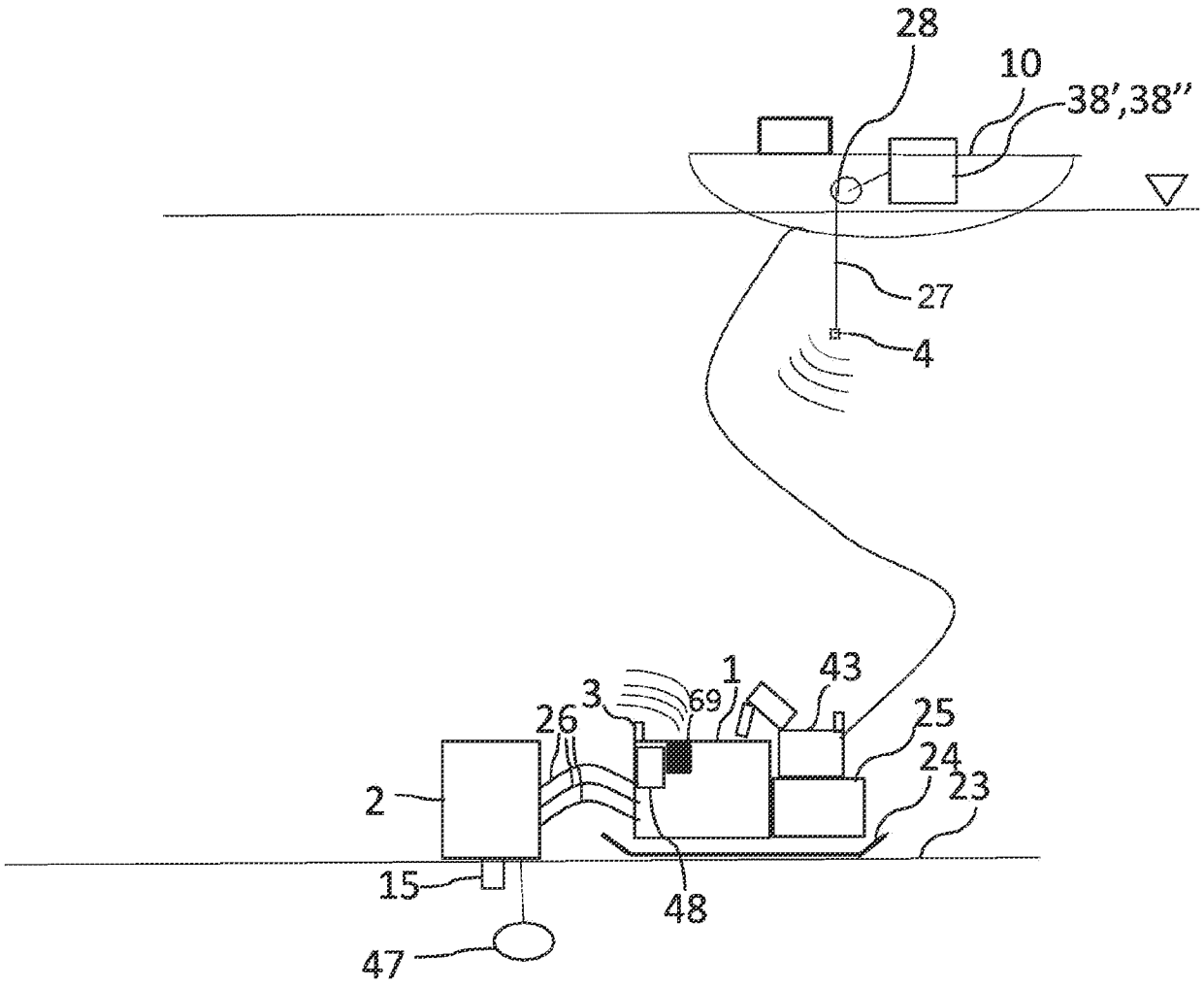
FIG. 10 shows an example of an additional communication system and/or an additional power supply where a ROV is docked to the skid for wired/cabled communication to the topside installation.

FIG. 10 shows an example of an additional communication system and/or additional power supply where a ROV 43 is docked to the skid 1 for wired/cabled communication to the topside installation 10. This solution utilizes the communication/power cable already present between the ROV 43 and the topside installation 10 as the ROV 43 is always wired/cabled to a topside installation 10. The cable enables the possibility of high-bandwidth communication as well as possibility of charging of the power source (battery) on the skid 1 and/or power boosting the skid 1. This may be advantageous as stored filtered data in the control system may be transferred via high bandwidth to the topside installation through the ROV cable(s).

Figure 11:
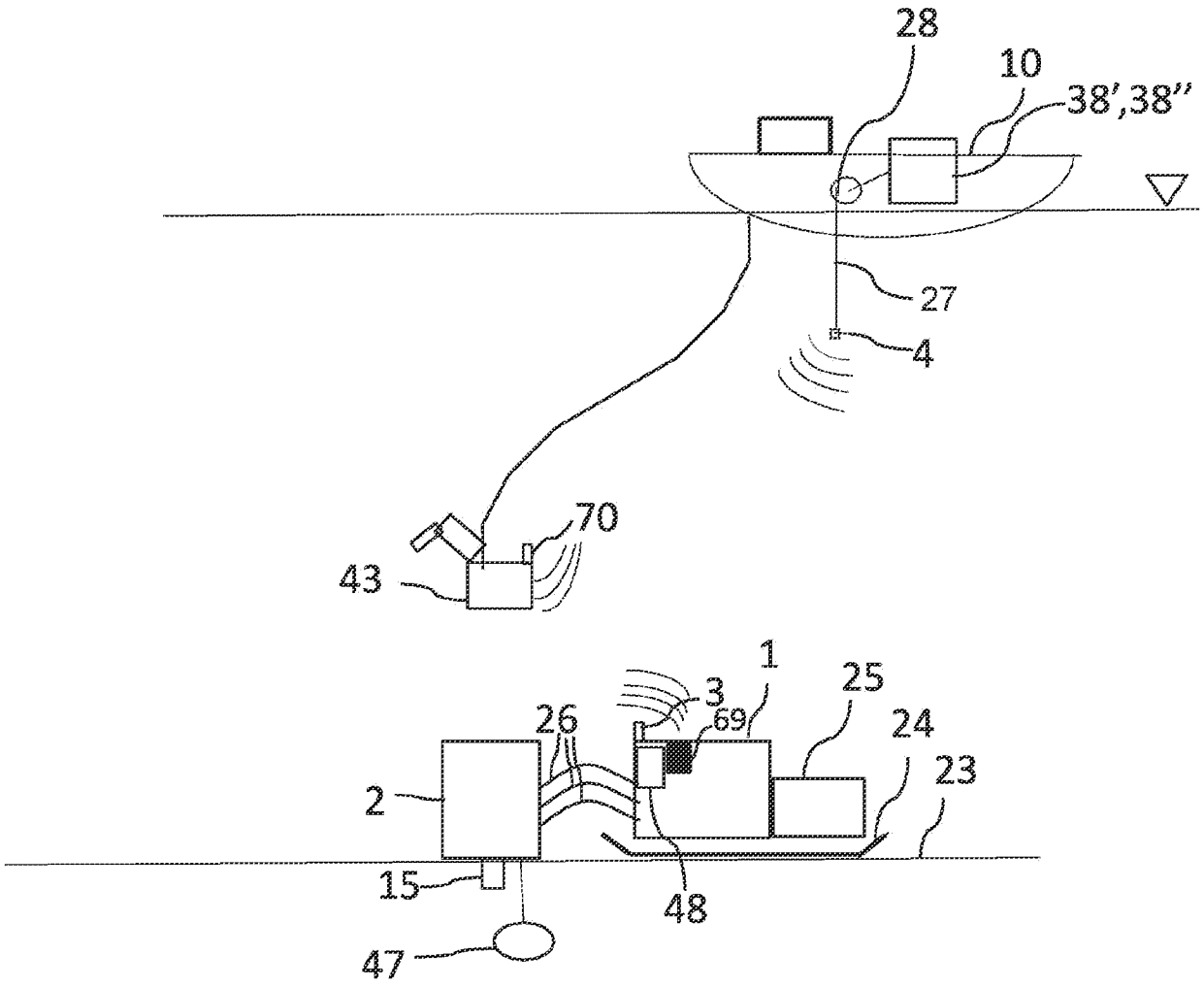
FIG. 11 shows an example of an additional communication system where a ROV is equipped with a wireless communication unit and the wireless communication unit on the skid communicates with the wireless communication unit on the ROV.

FIG. 11 shows an example of an additional communication system where a ROV 43 is equipped with a wireless communication unit 70 and the wireless communication unit 3 on the skid 1 communicates with the wireless communication unit 70 on the ROV 43. Shorter wireless distance, i.e. wireless communication between the wireless communication unit 3 on the skid 1 and a wireless communication unit 70 on the ROV 43 instead of between skid 1 and topside installation 10, renders possible higher bandwidth. This solution utilizes the communication cable already present between the ROV 43 and the topside installation 10 as the ROV 43 is always wired/cabled to a topside installation 10. The control system 69 is similar to the one described above in relation to e.g. FIG. 4C.

Figure 12:
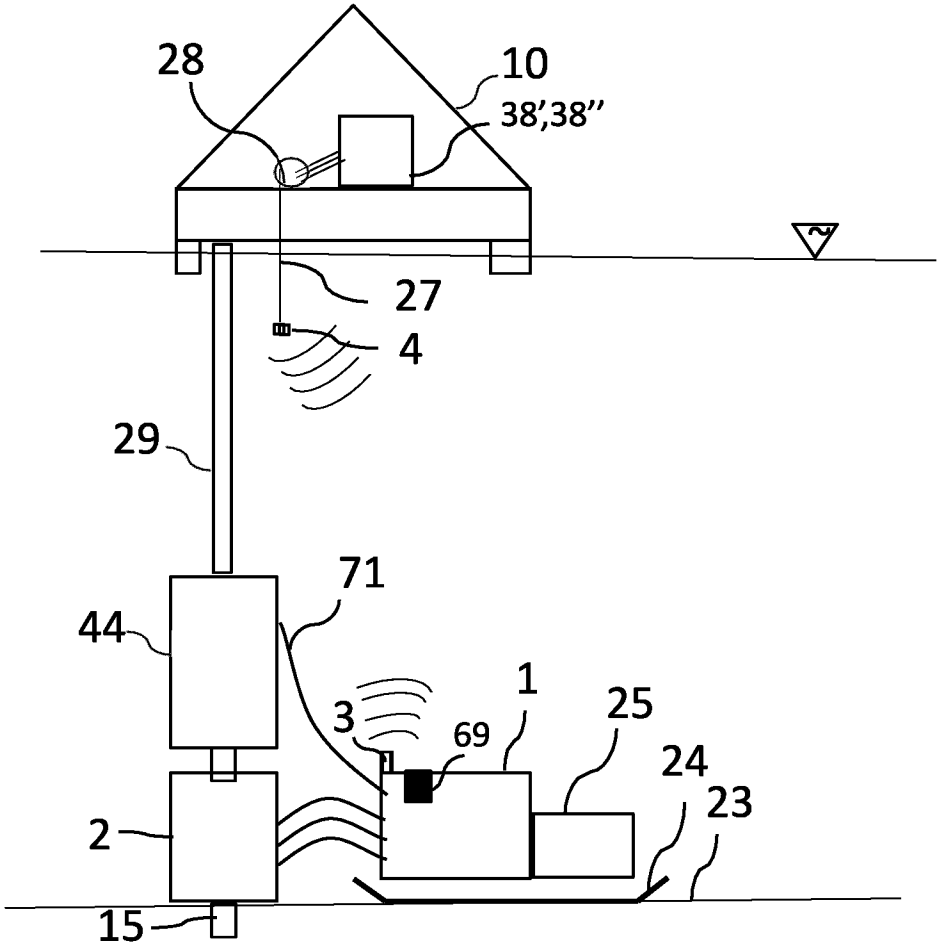
FIG. 12 shows an example of an additional communication system and/or additional power supply established by connection to a preinstalled communication line and/or power supply line present at the subsea location at or close to the subsea component.

FIG. 12 shows an example of an additional communication system and/or additional power supply established by connection to a preinstalled communication line and/or power supply line 71 present at the subsea location at or close to the subsea component 2. In this solution, infrastructure already present at the subsea location is used for providing the additional communication system and/or power supply. An example of already present infrastructure can be e.g. a floating platform 10 connected to a X-mas tree 2 subsea where the skid 1 is connected to cables or wires subsea. As shown in the example on FIG. 12, stored filtered data in the control system 69 may be transferred via high bandwidth to the topside installation 10 through the already present cable(s) 71 or large amounts of data can be transferred from the topside installation 10 to the control system 69 on the skid 1.

The invention is now explained with reference to non-limiting embodiments. However, a skilled person will understand that there may be made alternations and modifications to the embodiment that are within the scope of the invention as defined in the attached claims.

LIST OF REFERENCES

| | |
|---|---|
| 1 | installation and workover control system (IWOCS) skid |
| 2 | Subsea component |
| 3 | Wireless communication unit IWOCS |
| 4 | Wireless communication unit topside installation |
| 5 | Hydraulic fluid supply tank |
| 6 | Hydraulic fluid return tank |
| 7 | Electric power source |
| 8 | Chemical storage/ chemical injection fluid |
| 9 | Acoustic transponder |
| 10 | Topside installation |
| 11 | Subsea electronic module (SEM) |
| 12 | Valve pack |
| 13' | Low-pressure (LP) pump |
| 13" | High-pressure (HP) pump |
| 13" | Chemical pump |
| 14 | Lifting hooks |
| 15 | Well |
| 20 | Top part of the outer cover of skid |
| 21 | Outer side cover of the skid |
| 22 | wireline |
| 23 | seabed |
| 24 | mudmat |
| 25 | Jumper basket |
| 26 | Flying leads |
| 27 | Acoustic transponder cable |
| 28 | Acoustic reel |
| 29 | Landing string |
| 30 | riser |
| 31 | umbilical |
| 32 | Surface flow tree |
| 33 | swivel |
| 34 | Tension frame |

-continued

| | |
|---|---|
| 35 | gooseneck (tubing hanger mode) |
| 36' | HSLV sheave |
| 36" | LS sheave |
| 37' | HSLV umbilical and reel |
| 37" | LS umbilical and reel |
| 38', 38" | Master control systems |
| 39 | IWOCS remote control panel |
| 40 | ROV container |
| 41 | Umbilical reel |
| 42 | Tether management system (TMS) |
| 43 | Remotely operated vehicle, ROV |
| 44 | Blowout preventer (BOP) |
| 45 | Hydrate remediation skid |
| 46 | Line |
| 47 | Downhole instrumentation |
| 48 | Battery |
| 49 | Electrical line/ Communication line |
| 50 | Monitoring devices |
| 51 | Subsea Control Module (SCM) |
| 52 | XT com / power canister |
| 53 | Signal cable |
| 54 | Communication line |
| 55 | Variable frequency drive |
| 56', 56" | Lines to pump |
| 57 | Power lines |
| 58' | low-pressure supply line |
| 58" | high-pressure supply line |
| 59' | Low-pressure Quick dump valve |
| 59" | High-pressure Quick dump valve |
| 60 | Hydraulic test and function line(s) |
| 61 | Electric cable to topside installation |
| 62 | ROV multiplexer |
| 63 | Ethernet/OPC |
| 64 | Human Machine Interface (HMI) |
| 65 | router board |
| 66 | converter |
| 67 | PC |
| 68 | ROV multiplexer |
| 69 | Control system on skid |
| 70 | Wireless communication unit on ROV |
| 71 | Connection line to preinstalled communication line and or power supply line |

The invention claimed is:

1. A subsea deployable installation and workover control system (IWOCS) skid for connection to a subsea component, the skid comprising:

a first wireless communication unit for communication with a second wireless communication unit at a topside installation, each of the first and second wireless communication units comprising a respective acoustic transponder;

a control system configured for data storage and/or data filtering and for transferring the filtered data to the first wireless communication unit and receiving data from the first wireless communication unit;

a self-contained fluid system comprising a fluid supply tank, the fluid system being connectable to a fluid connection on the subsea component so as to provide fluid to the subsea component;

an electric power source for supplying electric power to the first wireless communication unit and the control system; and wherein the control system operates at least partly autonomously.

2. The skid according to claim 1, further comprising a pump unit for pressurizing fluid fed from the self-contained fluid system.

3. The skid according to claim 1, further comprising an additional communication system.

4. The skid according to claim 3, wherein the skid comprises means for switching functionality between the first wireless communication unit and the additional communication system.

5. The skid according to claim 3, wherein the additional communication system comprises a third wireless communication unit arranged on a Remotely Operated Vehicle (ROV), and wherein the first wireless communication unit on the skid communicates with the third wireless communication unit on the ROV.

6. The skid according to claim 3, wherein the additional communication system is arranged on an ROV which is docked to the skid.

7. The skid according to claim 3, wherein the additional communication system comprises a communication line which is connected between the skid and an ROV.

8. The skid according to claim 3, wherein the additional communication system is a connection to a preinstalled communication line located at the subsea location at or close to the subsea component.

9. A method of performing installation and/or workover operation(s) on a subsea component at a subsea location using an installation workover control system (IWOCS) skid, the skid comprising a first wireless communication unit for communication with a second wireless communication unit at topside installation, each of the first and second wireless communication units comprising a respective acoustic transponder, a control system configured for data storage and/or data filtering and for transferring the filtered data to the first wireless communication unit and receiving data from the first wireless communication unit, a self-contained fluid system comprising a fluid supply tank, the fluid system being connectable to a fluid connection on the subsea component so as to provide fluid to the subsea component, and an electric power source for supplying electric power to the first communication unit and the control system, the method comprising the steps of:

deploying the skid to a location subsea;

connecting the fluid system to the subsea component; and performing the installation and/or workover operations on the subsea component utilizing the fluid system;

wherein the control system is configured for partly autonomous operation and the method further comprises:

using the control system, receiving communication signals and in response thereto performing a required action in accordance with pre-programmed algorithms, wherein the required action comprises filtering said detected signals and communicating the filtered signals to the topside installation.

10. The method according to claim 9, further comprising controlling the skid from the topside installation via communication between the acoustic transponder of the second wireless communication unit and the acoustic transponder of the first wireless communication unit.

11. The method according to claim 10, further comprising connecting an additional communication system and/or an additional power supply to the skid.

12. The method according to claim 11, wherein the step of connecting an additional communication system to the skid comprises:

deploying an ROV subsea, wherein the ROV comprises a third wireless communication unit; and communicating with the topside installation via the third wireless communication unit on the ROV and the first wireless communication unit on the skid.

13. The method according to claim 11, wherein the step of connecting the additional communication system and/or the additional power supply to the skid comprises docking an ROV to the skid.

14. The method according to claim 11, wherein the step of connecting the additional communication system and/or the additional power supply to the skid comprises connecting an electrical line between an ROV and the skid.

15. The method according to claim 11, wherein after the skid has been deployed and installed at the subsea location, the step of connecting an additional communication system to the skid comprises connecting the skid to a preinstalled communication and power supply line at a subsea location at or close to the subsea location of the skid.

* * * * *